US008826970B2

(12) United States Patent
Shiraichi et al.

(10) Patent No.: US 8,826,970 B2
(45) Date of Patent: Sep. 9, 2014

(54) HEAT EXCHANGER AND HEAT EXCHANGING SYSTEM

(75) Inventors: Yukishige Shiraichi, Osaka (JP); Masaki Ohtsuka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1016 days.

(21) Appl. No.: 12/935,258

(22) PCT Filed: Apr. 3, 2009

(86) PCT No.: PCT/JP2009/056947

§ 371 (c)(1),
(2), (4) Date: Sep. 28, 2010

(87) PCT Pub. No.: WO2009/130984

PCT Pub. Date: Oct. 29, 2009

(65) Prior Publication Data

US 2011/0024093 A1 Feb. 3, 2011

(30) Foreign Application Priority Data

Apr. 23, 2008 (JP) ..... 2008-112273

(51) Int. Cl.

| | |
|---|---|
| ***F28F 1/14*** | (2006.01) |
| ***F28F 1/12*** | (2006.01) |
| ***F28F 1/32*** | (2006.01) |
| *F28D 1/03* | (2006.01) |

(52) U.S. Cl.

CPC ..... *F28F 1/32* (2013.01); *F28F 2250/08* (2013.01); *F28F 1/126* (2013.01); *F25B 2600/11* (2013.01)

USPC ..... 165/151; 165/152

(58) Field of Classification Search

CPC ..... F28F 1/32; F28F 1/325; F28F 1/105; F28F 1/126; F28F 1/24

USPC ..... 165/109.1, 151, 152, 181, 182

See application file for complete search history.

(56) References Cited

U.S. PATENT DOCUMENTS

| | | | | |
|---|---|---|---|---|
| 1,557,467 | A * | 10/1925 | Modine | 165/151 |
| 2,046,791 | A * | 7/1936 | Przyborowski | 165/151 |
| 4,178,767 | A | 12/1979 | Shaw | |
| 4,775,007 | A * | 10/1988 | Sakuma et al. | 165/151 |

(Continued)

FOREIGN PATENT DOCUMENTS

| | | |
|---|---|---|
| JP | 61-235695 A | 10/1986 |
| JP | 61-268988 A | 11/1986 |

(Continued)

OTHER PUBLICATIONS

English Translation of Decision on Grant, dated Mar. 4, 2009.

*Primary Examiner* — Tho V Duong

(74) *Attorney, Agent, or Firm* — Birch, Stewart, Kolasch & Birch, LLP

(57) ABSTRACT

A heat exchanging system (10) comprises a heat exchanger (1) including a tube (2) through which a first fluid flows and a plurality of fins (3) made from thin plates attached to the tube (2) and arranged parallel to each other in the direction along which the tube (2) extends, and a fan (4) for introducing a second fluid between the fins (3). The fin (3) includes concave parts (7) and convex parts (8) continuously and cyclically formed in a zigzag line. The concave parts (7) and the convex parts (8) are so arranged as to extend in the direction crossing the flow direction of the second fluid flowing between the fins (3), and the flow of the second fluid flowing between the fins (3) is made to be cyclically variable.

16 Claims, 25 Drawing Sheets

(56) References Cited

U.S. PATENT DOCUMENTS

| | | | | |
|---|---|---|---|---|
| 4,854,380 | A * | 8/1989 | Yoshida et al. | 165/152 |
| 4,984,626 | A * | 1/1991 | Esformes et al. | 165/151 |
| 5,095,711 | A | 3/1992 | Marris et al. | |
| 6,867,973 | B2 * | 3/2005 | Chang | 361/699 |
| 2007/0277538 | A1 | 12/2007 | Buck | |

FOREIGN PATENT DOCUMENTS

| | | | |
|---|---|---|---|
| JP | 62-29892 | A | 2/1987 |
| JP | 2-75897 | A | 3/1990 |
| JP | 2-217792 | A | 8/1990 |
| JP | 5-17366 | U | 3/1993 |
| JP | 9-264564 | A | 10/1997 |
| JP | 2001-20893 | A | 1/2001 |
| JP | 2001-289532 | A | 10/2001 |
| JP | 2006-275376 | A | 10/2006 |
| JP | 2008-70014 | A | 3/2008 |
| RU | 2 043 596 | C1 | 9/1995 |
| SU | 1460574 | A1 | 2/1989 |
| WO | WO 2007/130020 | A1 | 11/2007 |

* cited by examiner

HEAT EXCHANGER AND HEAT EXCHANGING SYSTEM

TECHNICAL FIELD

The present invention relates to a finned tube-type heat exchanger and a heat exchanging system using the same.

BACKGROUND ART

FIG. 28 shows a finned tube-type heat exchanger according to the conventional technique. In a heat exchanger 1, a plurality of thin plate-shaped fins 3 are attached to a tube 2 for a fluid to flow therethrough. In general, a fluid having a high heat transfer coefficient (such as, for example, water, $CO_2$, or a HCF-based refrigerant) is passed inside the tube 2, and a fluid having a low heat transfer coefficient (such as, for example, air) is passed outside the tube 2.

The fins 3 are arranged side by side in the extending direction of the tube 2, and heat exchange is performed between a fluid flowing through the tube 2 and a fluid supplied between the fins 3 as indicated by an arrow A1. On the outside of the tube 2, which has a low heat conductivity, the fins 3 increase a heat exchange area and thus allow a large heat exchange amount to be obtained. That is why a finned tube-type heat exchanger is in common use as a heat exchanger for performing heat exchange between gases and between a gas and a liquid.

The above-described finned tube-type heat exchanger 1 according to the conventional technique has presented a problem that, on a downstream side of the fins 3, a boundary layer of a flow in the vicinity of a surface of the fins 3 has an increased thickness, causing a decrease in heat transfer coefficient. In order to solve this problem, Patent Document 1 discloses a heat exchanger with fins having cut and raised portions. The cut and raised portions provided in the fins has a leading edge effect by which the thickness of a boundary layer of a flow in the vicinity of a surface of the fins can be decreased. This leads to a decrease in heat conductivity between the fins and a fluid and thus can improve heat exchange efficiency.

PRIOR ART DOCUMENT

Patent Document

Patent Document 1: JP-A-H 2-217792 (pages 1 to 4, FIG. 1)

DISCLOSURE OF THE INVENTION

Problems to be Solved by the Invention

However, according to the heat exchange disclosed in Patent Document 1 mentioned above, increasing the number of cut and raised portions results in an increase in flow path resistance, and thus there is a limitation on the number and arrangement of cut and raised portions. This has led to a problem of the difficulty in decreasing the thickness of the boundary layer all along the fins, thus failing to sufficiently decrease heat conductivity.

In view of the above-described problem with the conventional technique, an object of the present invention is to provide a heat exchanger that can decrease the thickness of a boundary layer of a flow in the vicinity of a surface of a fin, thereby allowing an improvement in heat exchange efficiency, and a heat exchanging system using the same.

Means for Solving the Problem

In order to achieve the above-described object, the present invention provides a heat exchanging system including: a heat exchanger having a tube for a first fluid to flow therethrough and a plurality of fins that are formed of thin plates, that are attached to the tube, and that are arranged side by side in an extending direction of the tube; and a fan for introducing a second fluid between the fins. The fins meander so as to have continuous concave and convex parts formed at a regular pitch. The concave and convex parts are arranged so as to extend in a direction intersecting a passage direction of the second fluid passing between the fins. A flow rate of the second fluid passing between the fins is made variable at a regular cycle.

According to this configuration, when the first fluid flows through the tube, heat of the first fluid is conducted to the fins. The plurality of the fins formed of thin plates are arranged side by side in the extending direction of the tube, and upon driving of the fan, the second fluid is supplied between the fins. The fins meander so as to have continuous concave and convex parts formed at a regular pitch, and the extending direction of the concave and convex parts intersects the passage direction of the second fluid. A portion of the second fluid flowing along the fins flows into the concave part, so that a vortex is formed in the concave part. With the flow rate of the second fluid delivered by the fan made variable at a regular cycle, stagnation of a vortex in the concave part and flowing-out of the second fluid from the concave part occur repeatedly.

Furthermore, in the present invention, in the heat exchanging system having the above-described configuration, a flow direction of the second fluid passing between the fins is inverted at a regular cycle. According to this configuration, the second fluid flows between the fins in a direction reversed at a predetermined cycle.

Furthermore, in the present invention, in the heat exchanging system having the above-described configuration, a flow direction of the second fluid being introduced to the fins is made variable at a regular cycle. According to this configuration, when flowing toward between the fins, the second fluid flows in a direction that varies at a regular cycle, and also, when flowing between the fins in various portions of the heat exchanger, the second fluid is at a velocity of a varying magnitude.

Furthermore, in the present invention, in the heat exchanging system having the above-described configuration, the concave and convex parts are arranged so as to extend in a direction orthogonal to the passage direction of the second fluid passing between the fins.

Furthermore, in the present invention, in the heat exchanging system having the above-described configuration, the concave part and the convex part of each of the fins face the concave part and the convex part of an adjacent one of the fins, respectively. According to this configuration, the second fluid flows along a surface of the convex part, and thus a pressure loss of a flow in a main flow direction can be reduced.

Furthermore, in the present invention, in the heat exchanging system having the above-described configuration, the concave part of each of the fins faces the convex part of an adjacent one of the fins. According to this configuration, even in the case where the fins are spaced at a decreased distance from each other, the second fluid flows while meandering and thus is allowed to travel without the occurrence of an increase in pressure loss.

Furthermore, in the present invention, in the heat exchanging system having the above-described configuration, the convex part has a flat surface portion parallel to the passage direction of the second fluid passing between the fins, and the flat surface portion is continuous with a side wall of the concave part and forms a right angle or an acute angle with the side wall of the concave part. According to this configuration, the second fluid flows along the flat surface portion perpendicularly to or at an acute angle with respect to the side wall of the concave part. Therefore, a portion of a flow of the second fluid is separated from the rest efficiently at the side wall of the concave part and thus is allowed to circulate into the concave part efficiently.

Furthermore, in the present invention, in the heat exchanging system having the above-described configuration, the concave part has a rectangular shape in cross-section. According to this configuration, the second fluid flows along the flat surface portion, and thus a pressure loss of a flow in a main flow direction can be reduced. In addition, a portion of a flow of the second fluid is separated from the rest efficiently, and renewal of a fluid in the concave part can be performed more efficiently than in the case where the side wall of the concave part is formed at an acute angle with respect to the main flow direction.

Furthermore, in the present invention, in the heat exchanging system having the above-described configuration, when the second fluid passes between the fins at a maximum flow velocity, a Reynolds number obtained with respect to a length of the concave part or the convex part in a passage direction as a representative length has a value larger than a critical Reynolds number. According to this configuration, when the second fluid is at a maximum flow velocity, the flow velocity is sufficiently high to allow a vortex in the concave part to have an increased angular velocity to become stagnant in the concave part.

Furthermore, in the present invention, in the heat exchanging system having the above-described configuration, when the second fluid passes between the fins at a minimum flow velocity, the Reynolds number obtained has a value smaller than the critical Reynolds number. According to this configuration, when the second fluid is at a minimum flow velocity, the flow velocity is sufficiently low to allow a vortex in the concave part to have a decreased angular velocity to be brought to a state where a portion thereof extends out of the concave part.

Furthermore, in the present invention, in the heat exchanging system having the above-described configuration, the fan is formed of an axial flow fan or a once-through fan, and a rotation direction of the fan is inverted at a regular cycle. According to this configuration, the use of one fan allows inversion of the flow direction of the second fluid throughout a wide region of the heat exchanger.

Furthermore, in the present invention, in the heat exchanging system having the above-described configuration, the fan is formed of an axial flow fan having a plurality of vane blades, and at least some of the vane blades are provided so as to have opposite angles of attack. According to this configuration, there is no need to invert forward/reverse rotation of a fan motor, thereby achieving a simplified mechanism. Furthermore, the fan is rotated at a cycle shorter than a cycle at which forward/reverse rotation of a fan motor is inverted, thereby allowing a passage direction to be inverted at an increased frequency within a fixed time period. Thus, stagnation and renewal of a fluid in the concave part can be performed at an increased frequency.

Furthermore, in the present invention, in the heat exchanging system having the above-described configuration, the fan is disposed on each of an upstream side and a downstream side of the heat exchanger, and the fan disposed on the upstream side and the fan disposed on the downstream side are driven alternately. More preferably, the fan is formed of a centrifugal fan such as a sirocco fan. The said fan presents higher blast performance with respect to a large flow path resistance than that of other types of fans such as an axial flow fan and a once-through fan. This configuration therefore is particularly suitable for, for example, a heat exchanging system in which a heat exchanger has an increased length in a passage direction, resulting in a large flow path resistance.

Furthermore, in the present invention, in the heat exchanging system having the above-described configuration, a guide unit that guides the second fluid is provided on an upstream side or a downstream side of the fan, and by the guide unit, a flow direction of the second fluid is made variable at a regular cycle. According to this configuration, the passage direction of the second fluid passing between the fins in various portions of the heat exchanger can be switched more swiftly than when inverting forward/reverse rotation of a fan motor and when switching between on/off states.

Furthermore, in the present invention, in the heat exchanging system having the above-described configuration, the fan is formed of a once-through fan or a centrifugal fan that is enclosed in a casing having a flow-in port and a flow-out port, the heat exchanger is disposed so as to surround a periphery of the fan, and the casing is configured to be rotatable. According to this configuration, particularly in the case where the heat exchanger is provided in such an arrangement as to surround the fan, the passage direction of the second fluid passing between the fins of the heat exchanger can be inverted through a circular movement of a fan casing alone, thereby providing an advantage of achieving a simplified structure.

The present invention also provides a heat exchanger including: a tube for a fluid to flow therethrough; and a plurality of fins that are formed of thin plates, that are attached to the tube, and that are arranged side by side in an extending direction of the tube. The fins meander so as to have continuous concave and convex parts formed at a regular pitch, which extend in one direction.

Advantages of the Invention

According to the present invention, the fins have the concave and convex parts that extend in a direction intersecting the flow direction of the second fluid, so that a portion of the second fluid passing between the fins forms a vortex in the concave part. Furthermore, the flow rate of the second fluid is made variable at a regular cycle, thereby providing an effect that heat transfer between the second fluid and the fins or the tube is enhanced via a vortex in the concave part. In addition, stagnation of the second fluid in the concave part and renewal of the second fluid in the concave part occur repeatedly, and thus heat transfer is performed steadily and efficiently. Thus, without dependence on heat conduction performance of the fins themselves, a region used for heat exchange between the fins and a flow between the fins can be spread throughout a surface of the fins, thereby allowing an improvement in heat exchange efficiency.

BEST MODE FOR CARRYING OUT THE INVENTION

First Embodiment

Figure 1:
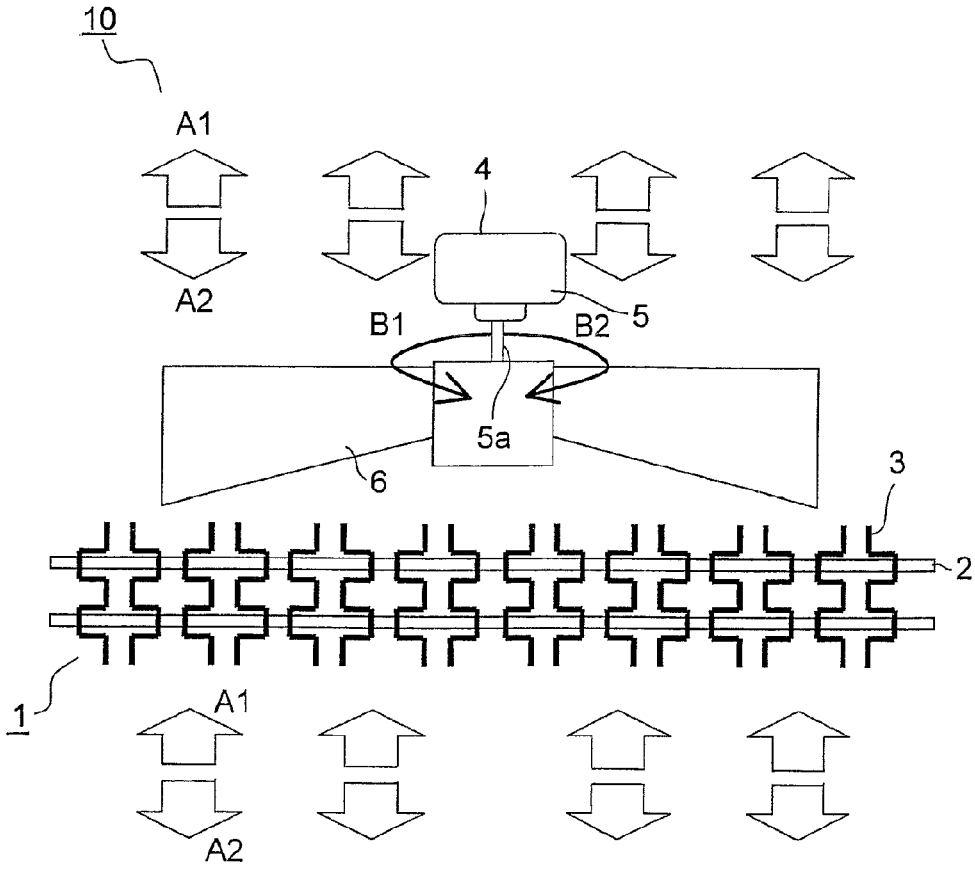
FIG. 1 A schematic structural view showing a heat exchanging system according to a first embodiment of the present invention.

The following describes an embodiment of the present invention with reference to the appended drawings. FIG. 1 is a schematic structural view showing a heat exchanging system according to a first embodiment. A heat exchanging system 10 includes a heat exchanger 1 and a fan 4. The heat exchanger 1 has a tube 2 for a first fluid such as water, $CO_2$, or a HCF-based refrigerant to flow therethrough and a fin 3 attached to the tube 2, and thus is of a finned tube-type.

The heat exchanging system 10 is placed in a second fluid such as air. A fan 4 is formed of an axial flow fan such as a propeller fan and has a vane 6 attached to a motor shaft 5*a* of a motor 5. In accordance with electric power used to drive the motor 5, the rpm (rotation speed) of the vane 6 changes sinusoidally, i.e. at a regular cycle, the rpm of the vane 6 is increased and decreased and the rotation direction thereof is inverted.

In this configuration, when the vane 6 rotates in a direction indicated by an arrow B1, a flow of the second fluid in a direction indicated by an arrow A1 is generated, and when the vane 6 rotates in a direction indicated by an arrow B2, a flow of the second fluid in a direction indicated by an arrow A2 is generated. Furthermore, increasing the rpm of the vane 6 increases the velocity of the second fluid and decreasing the rpm of the vane 6 decreases the velocity of the second fluid, and thus the second fluid flowing between the fins 3 is made variable in flow rate. When the second fluid flows between the fins 3, heat transferred from the first fluid to the fin 3 is provided to the second fluid, and heat exchange thus is performed.

Figure 2:
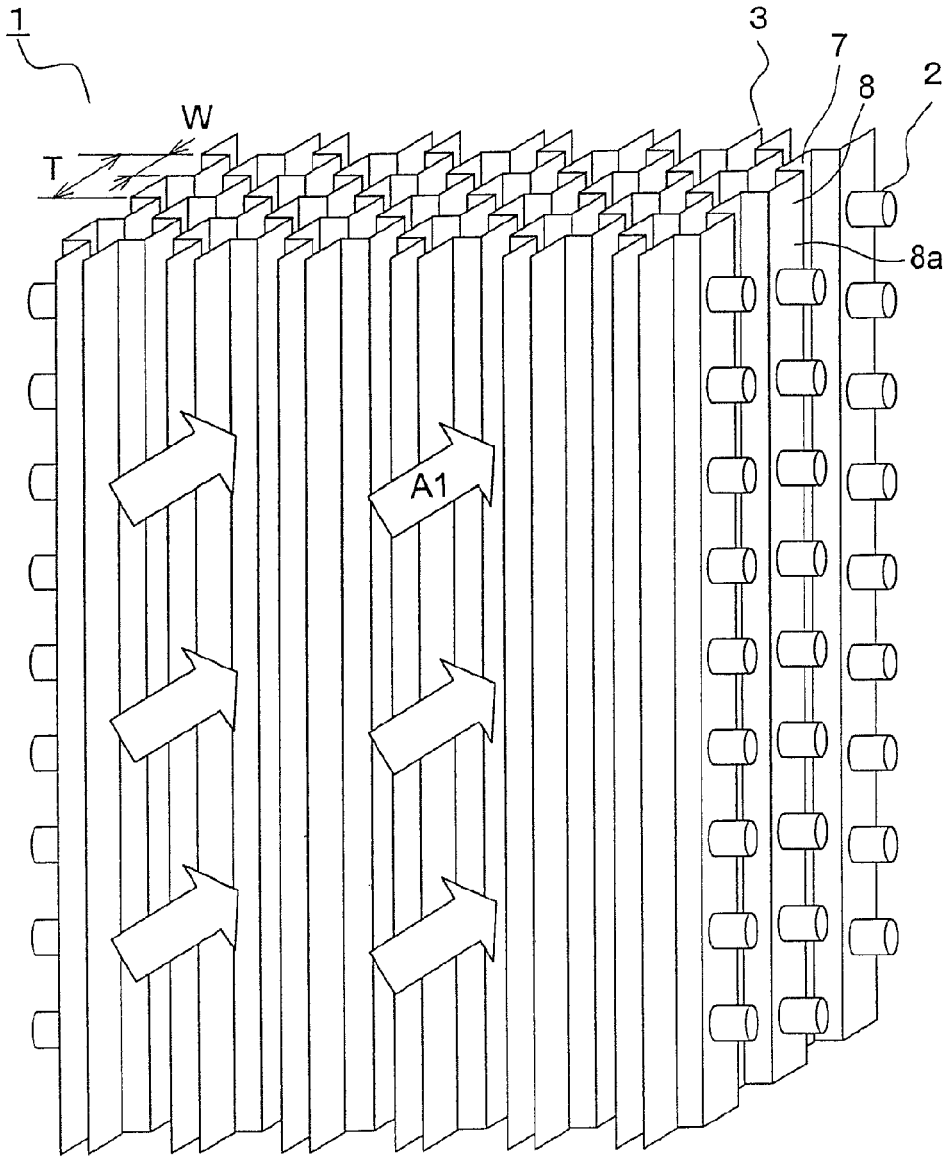
FIG. 2 A perspective view showing a heat exchanger of the heat exchanging system according to the first embodiment of the present invention.

FIG. 2 is a perspective view showing the heat exchanger 1 in detail. In the figure, the tubes 2 of a cylindrical shape extend in the lateral direction and are arranged side by side in the longitudinal direction and in the depth direction. The tubes 2 may be constituted by one tube or by a plurality of tubes. The fin 3 is formed of a thin plate having a high heat conductivity such as a metal plate, and a plurality of the fins 3 are arranged side by side in the extending direction of the tube 2. The fin 3 may be disposed perpendicularly or obliquely to the extending direction of the tube 2.

The fin 3 is bent to meander at a regular pitch, and therefore, on each surface thereof, a concave part 7 and a convex part 8 that extend in one direction are formed continuously. In this configuration, each of the concave parts 7 has a side wall shared with an adjacent one of the convex parts 8, and a pitch T is twice as long as a width W of the concave part 7 (convex part 8). The convex part 8 has a flat surface portion 8*a* by which adjacent ones of the concave parts 7 is linked to each other, and the flat surface portion 8*a* constitutes a bottom surface of each of the concave parts on the back surface side. The flat surface portion 8*a* is formed perpendicularly to the side wall of the concave part 7, and the concave part 7 has a rectangular shape in cross-section, which is open on one side. Furthermore, the concave parts 7 of adjacent ones of the fins 3 are arranged so that open sides thereof face each other.

The width W of the concave part 7 is somewhat larger than the diameter of the tube 2, and the tube 2 penetrates the flat surface portion 8*a* so that the entire body of the tube 2 in its diameter direction lies within one concave part 7. As will be described later, a vortex is formed in the concave part 7, and if the tube 2 is disposed so as to lie across plural ones of the concave parts 7 and the convex parts 8, vortexes of a shape distorted from a desired shape are increased. Disposing the tube 2 so that it lies within one concave part 7 can reduce vortexes of a shape distorted due to the tube 2.

The fan 4 is disposed so that its axial direction is parallel to a pitch direction of the concave part 7 and the convex part 8 of the fin 3. Therefore, a passage direction of an airflow generated by the fan 4 (the arrows A1 and A2) coincides with a direction in which the second fluid passes between the fins 3 (hereinafter, this direction may be referred to as a "main flow direction"). Although a passage direction of an airflow generated by the fan 4 may be oblique to the main flow direction, allowing the passage direction to coincide with the main flow direction can reduce a pressure loss. Furthermore, the concave part 7 and the convex part 8 are arranged so as to extend in a direction (the vertical direction in FIG. 2) orthogonal to a direction in which upon driving of the fan 4, the second fluid passes between the fins 3 (the arrows A1 and A2).

Figure 3:
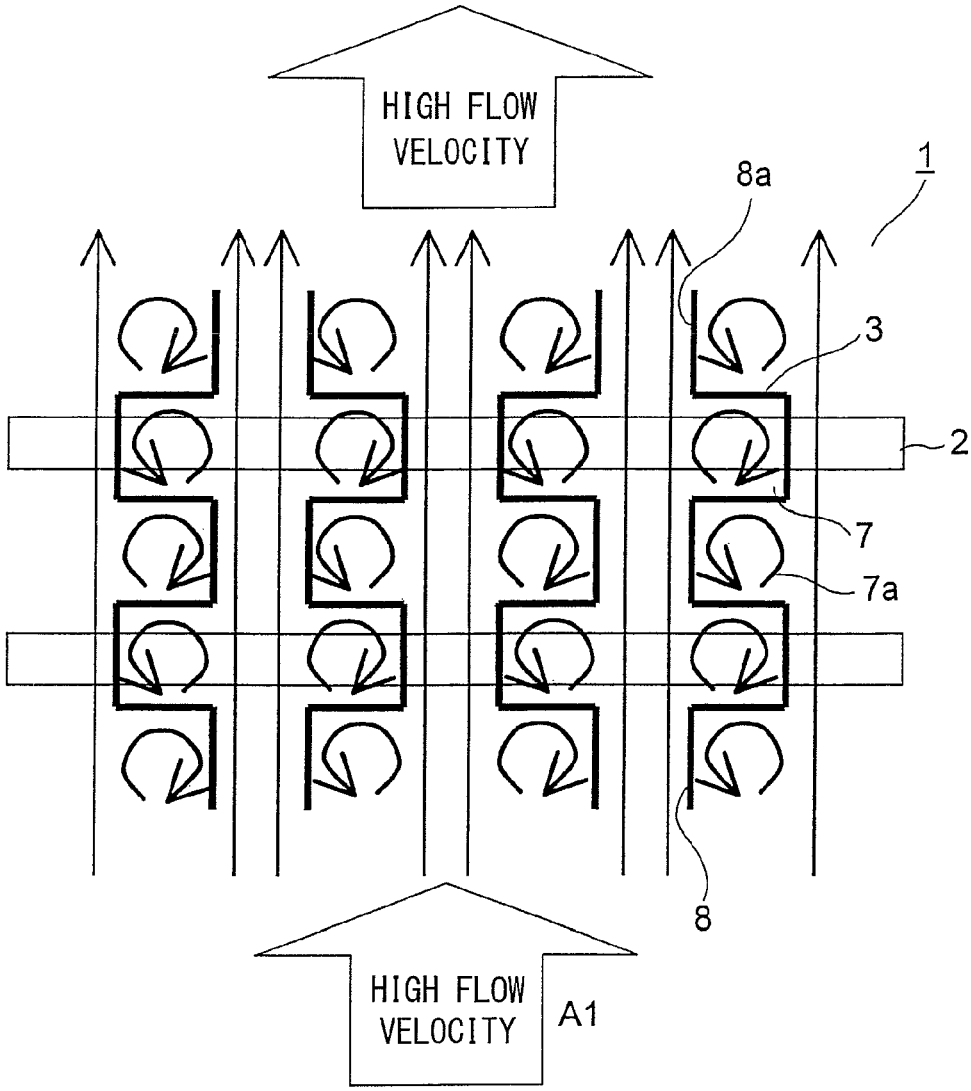
FIG. 3 A top view explaining a state where a second fluid passes through the heat exchanger of the heat exchanging system according to the first embodiment of the present invention.

FIGS. 3 to 7 are top views explaining states where the second fluid passes through the heat exchanger 1. FIG. 3 shows a state of the second fluid passing between the fins 3 at a maximum flow velocity. A Reynolds number Re obtained at this time with respect to the width W of the concave part 7 (equal to the width of the convex part 8) as a representative length has a value larger than a critical Reynolds number. As a result, a turbulent flow is generated between the fins 3 in the vicinity of the flat surface portion 8*a*.

The main flow direction of the second fluid flowing around the tube 2 coincides with a direction in which the second fluid is delivered by the fan 4 and is parallel to the flat surface portion 8*a*. This can reduce flow resistance and prevent the formation of a dead water (dead air) region.

The second fluid is at such a sufficiently high velocity that the Reynolds number Re obtained has a value exceeding the critical Reynolds number, so that heat of the second fluid between the fins 3 is transferred swiftly in the main flow direction via a flow. Meanwhile, as a result of the Reynolds number Re having a value exceeding the critical Reynolds number, a vortex 7*a* having a large angular velocity is generated in the concave part 7. Because of this, the heat flux in the vicinity of a surface of the fin 3 or the tube 2 becomes high, and thus heat exchange between a portion of the second fluid in the concave part 7 and the fin 3 or the tube 2 is enhanced considerably. At this point in time, the vortex 7*a* stays in the concave part 7 and becomes stagnant (hereinafter, this phenomenon is referred to as "stagnation of a fluid in the concave part").

Figure 4:
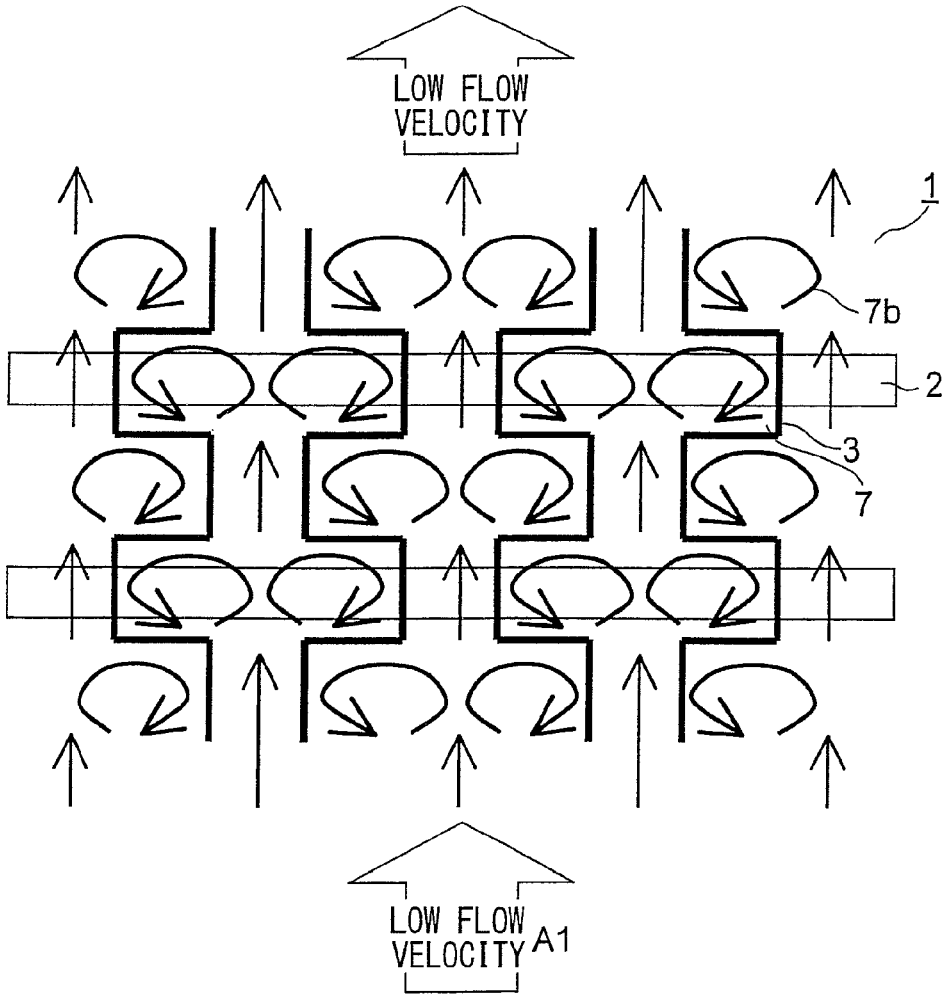
FIG. 4 A top view explaining a state where the second fluid passes through the heat exchanger of the heat exchanging system according to the first embodiment of the present invention.

When the velocity of the second fluid passing between the fins 3 is decreased, the state shown in FIG. 4 is brought about. The Reynolds number Re obtained at this time has a value smaller than the critical Reynolds number. In this state, in the concave part 7, a vortex 7*b* is formed that has a decreased angular velocity and thus has a portion extending out of the concave part 7. Accordingly, the vortex 7*b* has a center shifted positionally with respect to the vortex 7*a* (see FIG. 3). As a result, with respect to the heat transferred away from the fin 3 by the vortex 7*a* in the concave part 7 in FIG. 3, heat exchange is performed between a portion of that heat and a flow between the fins 3. Moreover, while heat resulting therefrom is transferred in the main flow direction, heat exchange between a portion of the heat thus being transferred and the vortex 7*b* in one of the concave parts 7 positioned forward in a traveling direction further is performed.

Figure 5:
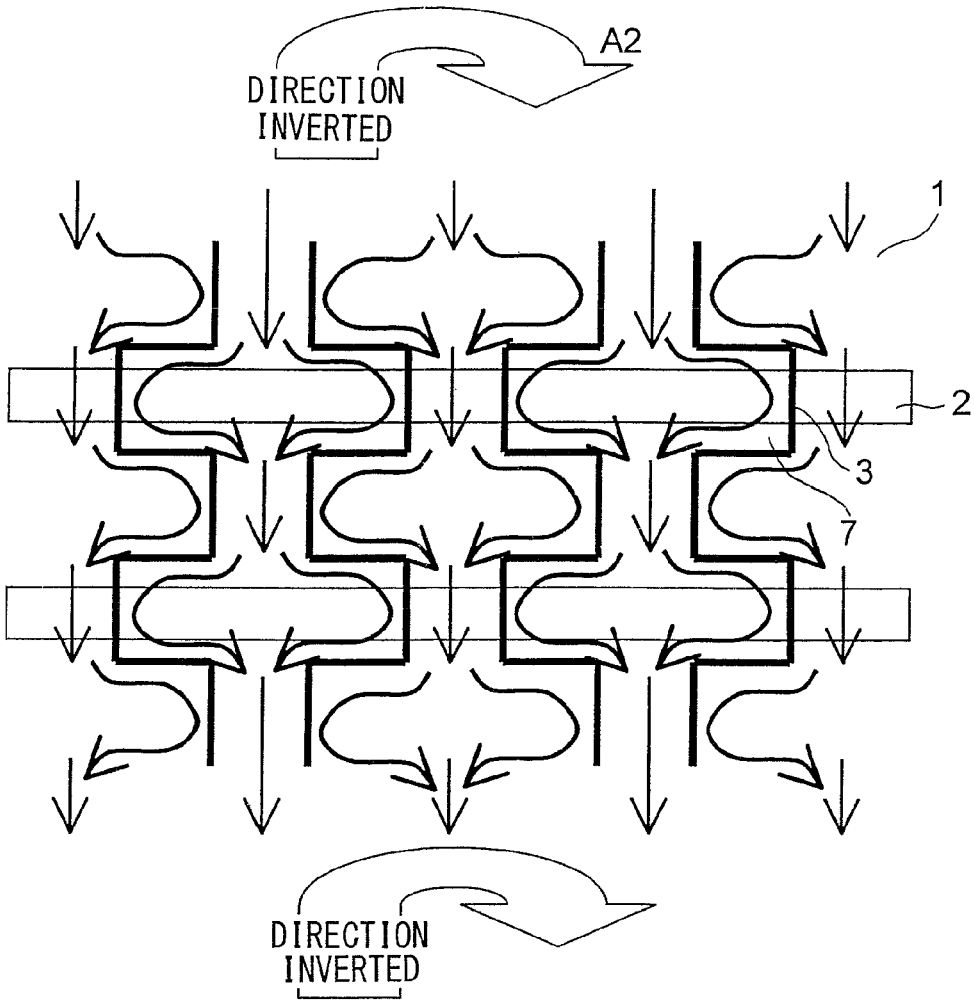
FIG. 5 A top view explaining a state where the second fluid passes through the heat exchanger of the heat exchanging system according to the first embodiment of the present invention.

When the velocity of the second fluid passing between the fins 3 is decreased to such an extent that the flow direction of the second fluid is inverted as indicated by the arrow A2, the state shown in FIG. 5 is brought about. In this state, since the main flow direction is reversed while a slight influence of an angular velocity remains in the concave part 7, there is formed a flow substantially along the concavities and convexities of the fin 3. As a result, a portion of the second fluid that has stayed in the concave part 7, along with heat, is transferred in the main flow direction, and a portion of a flow between the fins 3, along with heat, flows into the concave part 7. That is, a portion of the second fluid in the concave part 7 flows out therefrom and a fresh portion of the second fluid flows into the concave part 7, thus renewing the second fluid in the concave part 7 (hereinafter, this phenomenon is referred to as "renewal of a fluid in the concave part").

Figure 6:
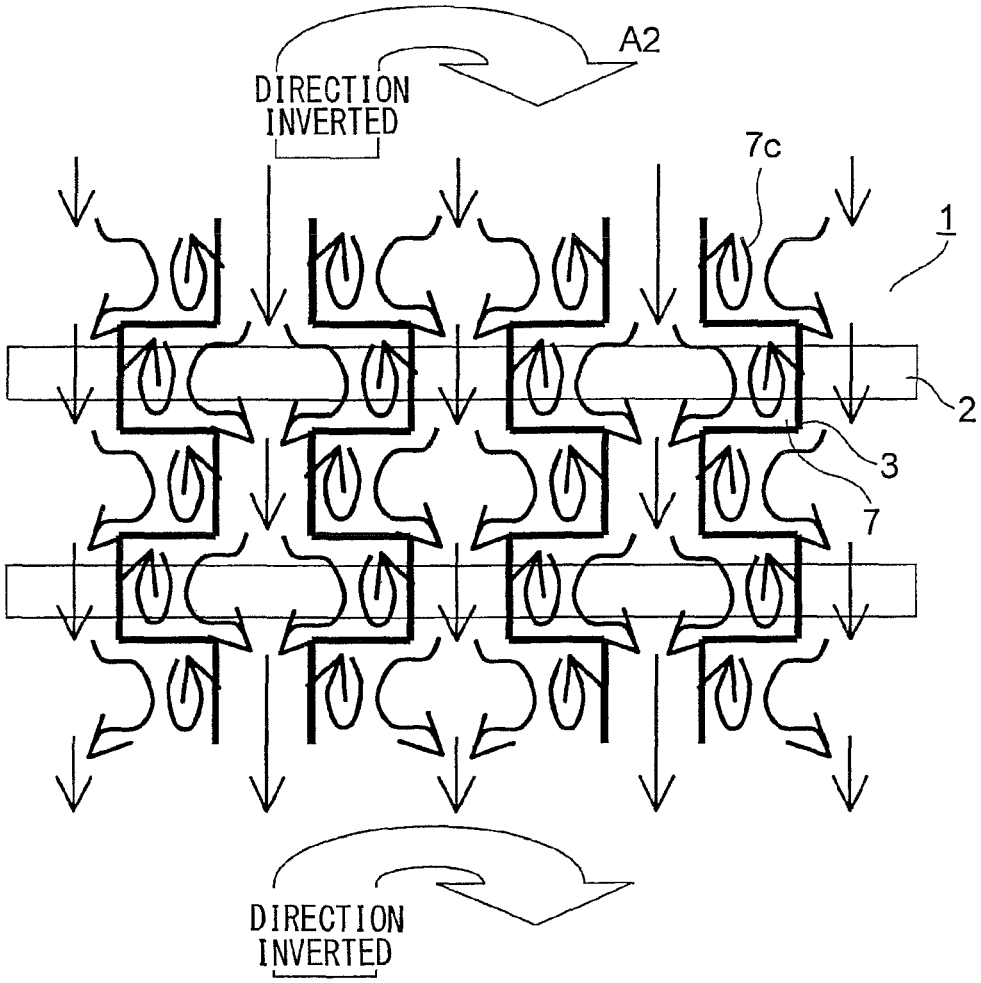
FIG. 6 A top view explaining a state where the second fluid passes through the heat exchanger of the heat exchanging system according to the first embodiment of the present invention.

When the velocity of the second fluid is increased after a further elapse of time, the state shown in FIG. 6 is brought about. In this state, the influence of the inertia of the second fluid and of a tangential resistance on a surface of the fin 3 increases with an increase in the velocity, so that it gradually becomes difficult to flow along the concavities and convexities of the fin 3. As a result, a vortex 7*c* begins to be generated at a bottom surface of the concave part 7.

Figure 7:
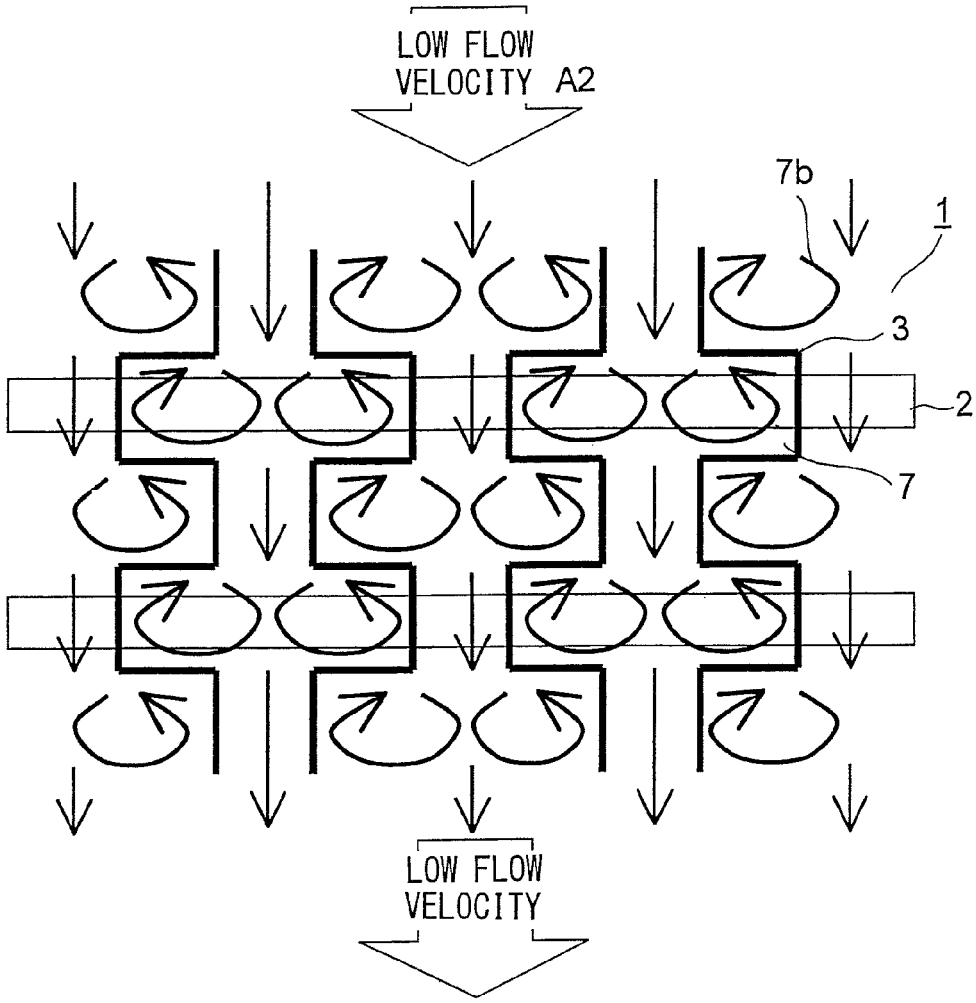
FIG. 7 A top view explaining a state where the second fluid passes through the heat exchanger of the heat exchanging system according to the first embodiment of the present invention.

When the velocity of the second fluid is increased further to a velocity whose flow direction is reversed from that in the previously described state shown in FIG. 4 and whose magnitude is equal to that in the same state, the state shown in FIG. 7 is brought about. In this state, as a developed form of the vortex 7*c* generated as shown in FIG. 6, a vortex 7*b* whose magnitude is equal to that in the state shown in FIG. 4 and whose rotation direction is inverted from that in the same state is formed. Thus, heat is transferred in the main flow direction.

The velocity of the second fluid is increased further to a velocity whose flow direction is reversed from that in the previously described state shown in FIG. 3 and whose magnitude is equal to that in the same state. As a result, similarly to the previously described state, heat of the second fluid between the fins 3 is transferred swiftly in the main flow direction via a flow. Meanwhile, a vortex 7*a* having a large angular velocity is generated in the concave part 7. Thereafter, the states shown respectively in FIGS. 3 to 7 are brought about repeatedly, during which time a flow of the second fluid changes, i.e. the velocity of the second fluid is made variable in magnitude (flow rate) and is inverted in flow direction.

According to this embodiment, the concave part 7 and the convex part 8 are provided in the fin 3, which extend in a direction orthogonal to the flow direction of the second fluid, so that a portion of the second fluid passing between the fins 3 forms a vortex in the concave part 7. Furthermore, the flow rate of the second fluid is made variable at a regular cycle, thereby providing an effect that heat transfer between the second fluid and the fin 3 or the tube 2 is enhanced via the vortex 7*a*, 7*b*, or 7*c* in the concave part 7. In addition, stagnation of a fluid in the concave part and renewal of the fluid in the concave part occur repeatedly, and thus heat transfer in the main flow direction A1/A2 is performed steadily and efficiently. Thus, without dependence on heat conduction performance of the fin 3 itself, a region used for heat exchange between the fin 3 and a flow of the second fluid between the fins 3 can be spread throughout a surface of the fin 3, thereby allowing an improvement in heat exchange efficiency.

This makes it possible, for example, to use as the fin 3, a fin having a length in the flow direction of the second fluid longer than that of a conventionally used fin and to use as a material for the fin 3, a material having heat conduction performance lower than that of a conventionally used material. Even in such cases, it is possible to effectively improve heat transfer performance instead of incurring a conventional problem of deteriorating the same.

Furthermore, the flow direction of the second fluid passing between the fins 3 is inverted at a regular cycle, and thus the formation of a dead water (dead air) region in a downstream portion of the tube 2 can be prevented to a greater degree than in the conventional technique. This can increase an effective cross-sectional area of the heat exchanger 1.

As long as the concave part 7 and the convex part 8 extend in a direction intersecting the flow direction of the second fluid, the vortexes 7*a*, 7*b*, and 7*c* are formed similarly and a similar effect can be obtained. However, in the case where the concave part 7 and the convex part 8 extend in a direction orthogonal to the flow direction of the second fluid, a portion of a flow of the second fluid is separated from the rest efficiently at the side wall of the concave part 7. Thus, the portion of the second fluid is allowed to circulate into the concave part 7 efficiently to form an intense vortex as the vortex 7*a*, thereby allowing heat transfer in the concave part 7 to be performed more efficiently.

Furthermore, the side wall of the concave part 7 may be formed obliquely to the main flow direction. However, the side wall of the concave part 7 formed perpendicularly to the main flow direction allows a portion of a flow of the second fluid to be separated from the rest efficiently at the side wall of the concave part 7. This makes it possible to form an intensified vortex as the vortex 7*a*, thereby allowing heat transfer in the concave part 7 to be performed more efficiently. In the case where the side wall of the concave part 7 is formed at an acute angle with respect to the main flow direction, a portion of a flow of the second fluid is separated from the rest more efficiently to allow an intense vortex to be formed as the vortex 7*a*.

Furthermore, the concave part 7 is formed in a rectangular shape, and the flat surface portion 8*a* is formed. Therefore, the second fluid flows along the flat surface portion 8*a*, and thus a pressure loss of a flow in the main flow direction can be reduced. In addition, a portion of a flow of the second fluid is separated from the rest efficiently as described above, and the side wall of the concave part 7 formed at a right angle with respect to the main flow direction in this manner allows renewal of a fluid in the concave part to be performed more efficiently than when it is formed at an acute angle with respect to the main flow direction.

Furthermore, the concave parts 7 of adjacent ones of the fins 3 are provided so that open sides thereof face each other, which prevents a flow in the main flow direction from meandering and thus can reduce a pressure loss. Furthermore, since a main flow does not meander, particularly at a point in time when the velocity of the main flow becomes high, the entry of the main flow into the concave part 7 can be suppressed. Thus, stagnation of a fluid in the concave part 7 can be achieved more reliably.

Furthermore, although the fan 4 may be formed of a once-through fan or a centrifugal fan, using an axial flow fan as the fan 4 can provide a wide flow path cross-sectional area, reduce a pressure loss, and supply a large volume of air. Therefore, in the case where, as in this embodiment, the heat exchanger 1 has a length in the main flow direction relatively small compared with its dimensions in other directions, a flow in the main flow direction can be formed easily. Furthermore, forward/reverse inversion of a passage direction also can be performed relatively easily through inversion of forward/reverse rotation of the fan 4.

Although in the foregoing description, the rotation direction of the vane 6 is inverted by the fan 4 so that the flow direction of the second fluid is inverted, it also is possible that the rpm of the vane 6 is increased and decreased with the rotation direction thereof fixed. In this case, the second fluid is made variable in flow rate with the flow direction thereof fixed, and the previously described states shown in FIGS. 3 and 4 are brought about repeatedly. Thus, a region used for heat exchange between the fin 3 and a flow between the fins 3 can be spread throughout a surface of the fin 3, thereby allowing an improvement in heat exchange efficiency.

Second Embodiment

The description is next directed to a heat exchanging system 10 according to a second embodiment. This embodiment has a configuration similar to the previously described configuration of the first embodiment shown in FIG. 1 and is different therefrom in arrangement of fins 3. FIGS. 8 to 12 are top views explaining states where a second fluid passes through a heat exchanger 1. In the heat exchanger 1, a concave part 7 and a convex part 8 of the fin 3 are arranged so that the concave part 7 of each of the fins 3 faces the convex part 8 of an adjacent one of the fins 3. Parts other than these are configured similarly to those of the first embodiment.

Figure 8:
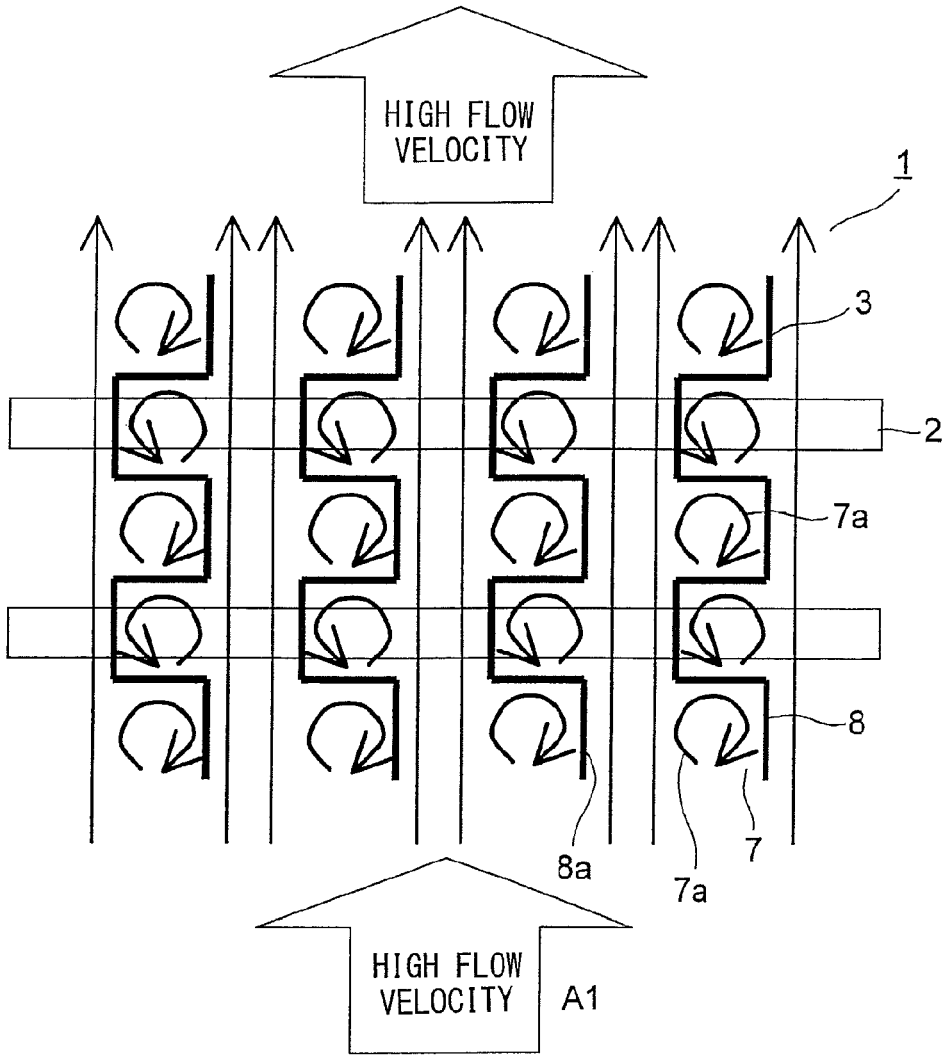
FIG. 8 A top view explaining a state where a second fluid passes through a heat exchanger of a heat exchanging system according to a second embodiment of the present invention.

FIG. 8 shows a state of the second fluid passing between the fins 3 at a maximum flow velocity. A Reynolds number Re obtained at this time with respect to a width W of the concave part 7 (see FIG. 2) as a representative length has a value larger than a critical Reynolds number.

A main flow direction of the second fluid flowing around a tube 2 coincides with a direction in which the second fluid is delivered by a fan 4 and is parallel to a flat surface portion 8*a*. This can reduce flow resistance and prevent the formation of a dead water region.

The second fluid is at such a sufficiently high velocity that the Reynolds number Re obtained has a value exceeding the critical Reynolds number, so that heat of the second fluid between the fins 3 is transferred swiftly in the main flow direction via a flow. Meanwhile, as a result of the Reynolds number Re having a value exceeding the critical Reynolds number, a vortex 7*a* having a large angular velocity is generated in the concave part 7. Because of this, the heat flux in the vicinity of a surface of the fin 3 or the tube 2 becomes high, and thus heat exchange between a portion of the second fluid in the concave part 7 and the fin 3 or the tube 2 is enhanced considerably. At this point in time, the vortex 7*a* stays in the concave part 7 and becomes stagnant (stagnation of a fluid in the concave part).

Figure 9:
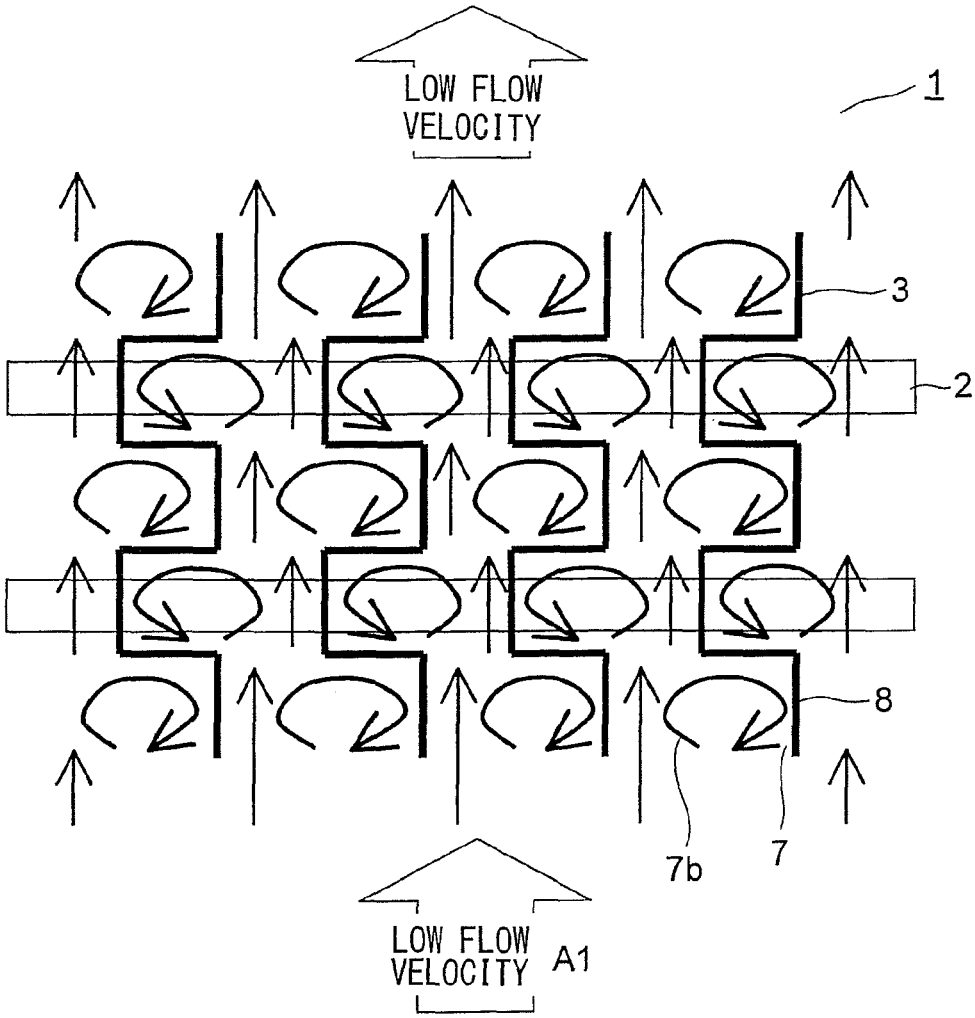
FIG. 9 A top view explaining a state where the second fluid passes through the heat exchanger of the heat exchanging system according to the second embodiment of the present invention.

When the velocity of the second fluid passing between the fins 3 is decreased, the state shown in FIG. 9 is brought about. The Reynolds number Re obtained at this time has a value smaller than the critical Reynolds number. In this state, in the concave part 7, a vortex 7*b* is formed that has a decreased angular velocity and thus has a portion extending out of the concave part 7. Accordingly, the vortex 7*b* has a center shifted positionally with respect to the vortex 7*a* (see FIG. 8). As a result, with respect to the heat transferred away from the fin 3 by the vortex 7*a* in the concave part 7 in FIG. 8, heat exchange is performed between a portion of that heat and a flow between the fins 3. Moreover, while heat resulting therefrom is transferred in the main flow direction, heat exchange between a portion of the heat thus being transferred and the vortex 7*b* in a forward-positioned one of the concave parts 7 further is performed.

Figure 10:
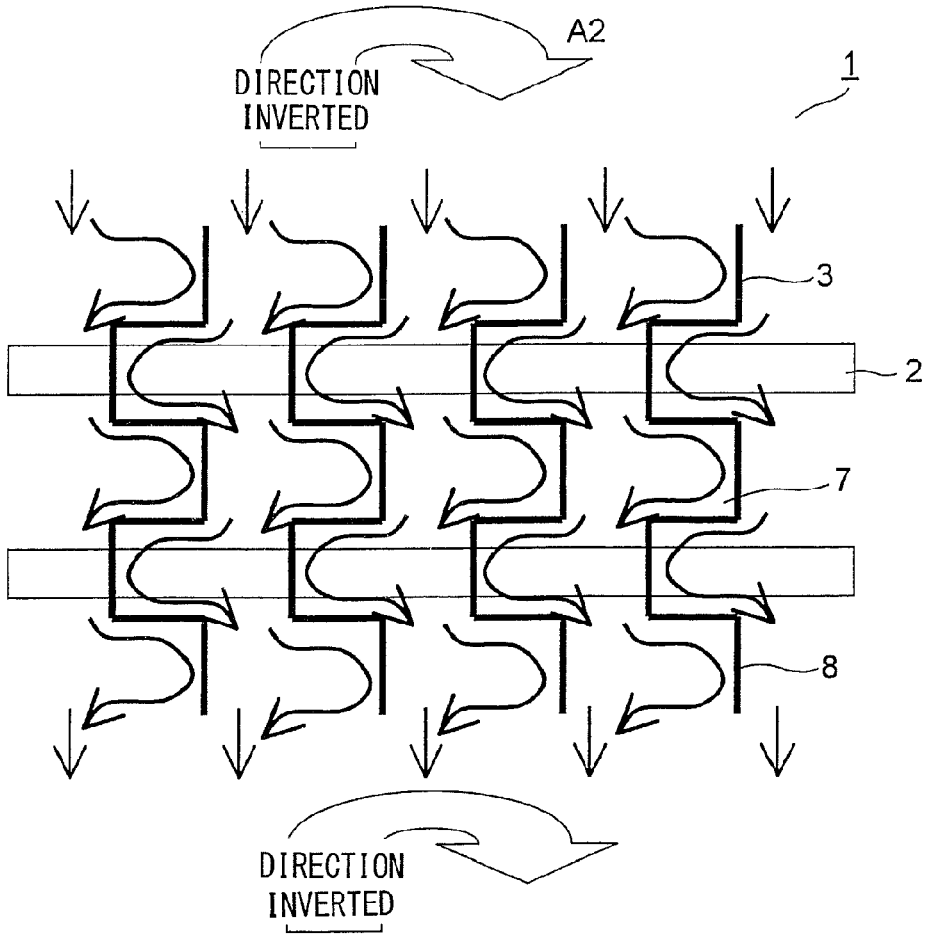
FIG. 10 A top view explaining a state where the second fluid passes through the heat exchanger of the heat exchanging system according to the second embodiment of the present invention.

When the velocity of the second fluid passing between the fins 3 is decreased to such an extent that the flow direction of the second fluid is inverted as indicated by an arrow A2, the state shown in FIG. 10 is brought about. In this state, since the main flow direction is reversed while a slight influence of an angular velocity remains in the concave part 7, there is formed a flow substantially along the concavities and convexities of the fin 3. As a result, a portion of the second fluid that has stayed in the concave part 7, along with heat, is transferred in the main flow direction, and a flow between the fins 3, along with heat, flows into the concave part 7. That is, a portion of the second fluid in the concave part 7 flows out therefrom and a fresh portion of the second fluid flows into the concave part 7, thus renewing the second fluid in the concave part 7 (renewal of a fluid in the concave part).

Figure 11:
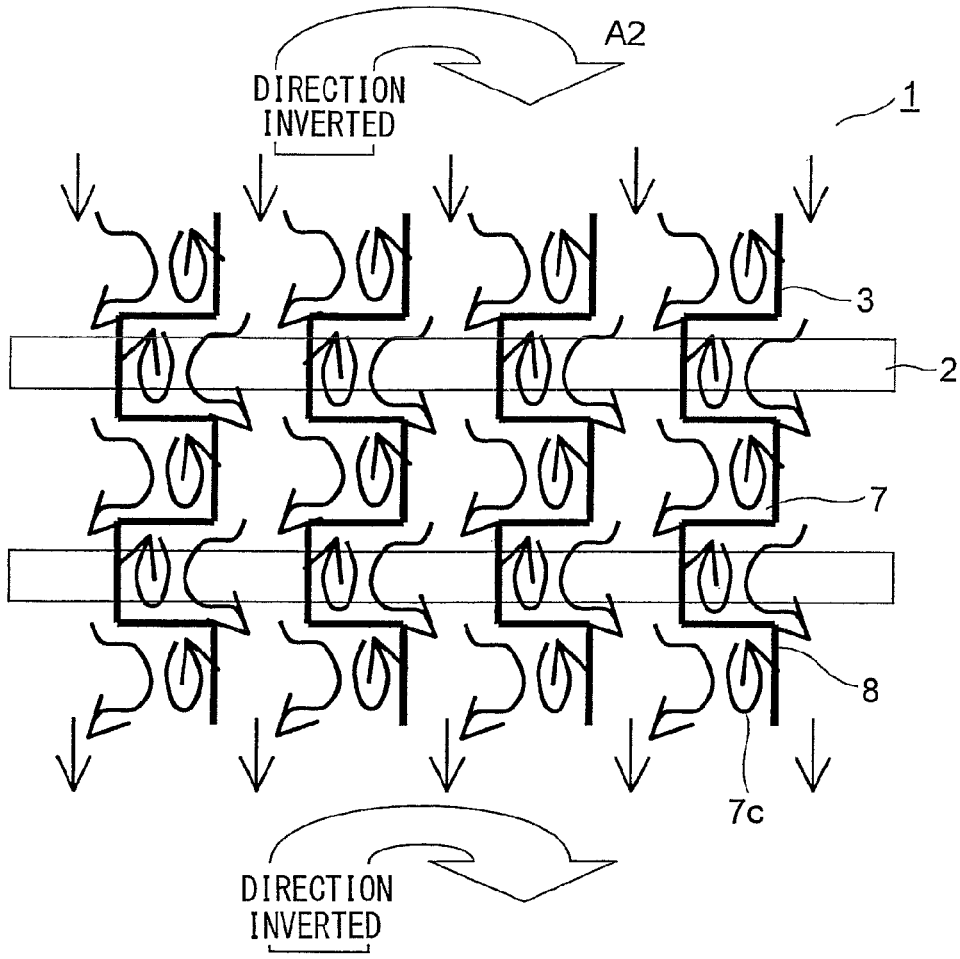
FIG. 11 A top view explaining a state where the second fluid passes through the heat exchanger of the heat exchanging system according to the second embodiment of the present invention.

When the velocity of the second fluid is increased after a further elapse of time, the state shown in FIG. 11 is brought about. In this state, the influence of the inertia of the second fluid and of a tangential resistance on a surface of the fin 3 increases with an increase in the velocity, so that it gradually becomes difficult to flow along the concavities and convexities of the fin 3. As a result, a vortex 7*c* begins to be generated at a bottom surface of the concave part 7.

Figure 12:
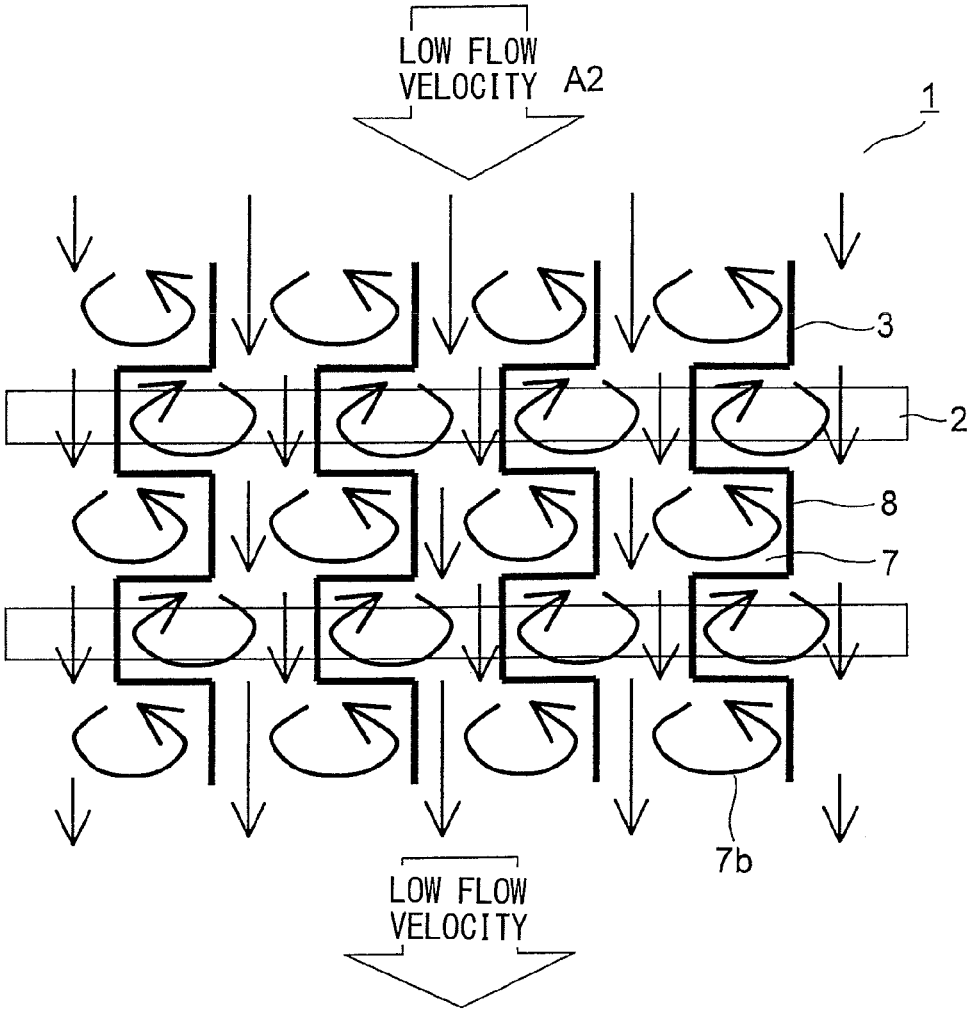
FIG. 12 A top view explaining a state where the second fluid passes through the heat exchanger of the heat exchanging system according to the second embodiment of the present invention.

When the velocity of the second fluid is increased further to a velocity whose flow direction is reversed from that in the previously described state shown in FIG. 9 and whose magnitude is equal to that in the same state, the state shown in FIG. 12 is brought about. In this state, as a developed form of the vortex 7*c* generated as shown in FIG. 11, a vortex 7*b* whose magnitude is equal to that in the state shown in FIG. 9 and whose rotation direction is inverted from that in the same state is formed. Thus, heat is transferred in the main flow direction.

The velocity of the second fluid is increased further to a velocity whose flow direction is reversed from that in the previously described state shown in FIG. 8 and whose magnitude is equal to that in the same state. As a result, similarly to the previously described state, heat of the second fluid between the fins 3 is transferred swiftly in the main flow direction via a flow. Meanwhile, a vortex 7*a* having a large angular velocity is generated in the concave part 7. Thereafter, the states shown respectively in FIGS. 8 to 12 are brought about repeatedly, during which time a flow of the second fluid changes, i.e. the velocity of the second fluid is made variable in magnitude (flow rate) and is inverted in flow direction.

According to this embodiment, similarly to the first embodiment, the concave part 7 and the convex part 8 are provided in the fin 3, which extend in a direction orthogonal to the flow direction of the second fluid, so that a portion of the second fluid passing between the fins 3 forms a vortex in the concave part 7. Furthermore, the flow rate of the second fluid is made variable at a regular cycle, thereby providing an effect that heat transfer between the second fluid and the fin 3 or the tube 2 is enhanced via the vortex 7*a*, 7*b*, or 7*c* in the concave part 7. In addition, stagnation of a fluid in the concave part and renewal of the fluid in the concave part occur repeatedly, and thus heat transfer in the main flow direction A1/A2 is performed steadily and efficiently. Thus, without dependence on heat conduction performance of the fin 3 itself, a region used for heat exchange between the fin 3 and a flow between the fins 3 can be spread throughout a surface of the fin 3, thereby allowing an improvement in heat exchange efficiency.

Furthermore, the flow direction of the second fluid passing between the fins 3 is inverted at a regular cycle, and thus the formation of a dead water region in a downstream portion of the tube 2 can be prevented to a greater degree than in the conventional technique. This can increase an effective cross-sectional area of the heat exchanger 1.

Furthermore, the concave part 7 of each of the fins 3 faces the convex part 8 of an adjacent one of the fins 3, and therefore, even in the case where the fins 3 are spaced at a decreased distance from each other, the second fluid meanders and thus is allowed to travel without the occurrence of an increase in pressure loss.

The side wall of the concave part 7 may be oblique to the main flow direction, and, more preferably, it forms a right angle or an acute angle with the flat surface portion 8*a*. Furthermore, the concave part 7 and the convex part 8 may extend in a direction oblique to the main flow direction. Moreover, it also is possible that the rpm of the vane 6 is increased and decreased with the vane 6 rotated in one direction. In this case, the second fluid is made variable in flow rate with the flow direction thereof fixed, and the previously described states shown in FIGS. 8 and 9 are brought about repeatedly.

Third Embodiment

Figure 13:
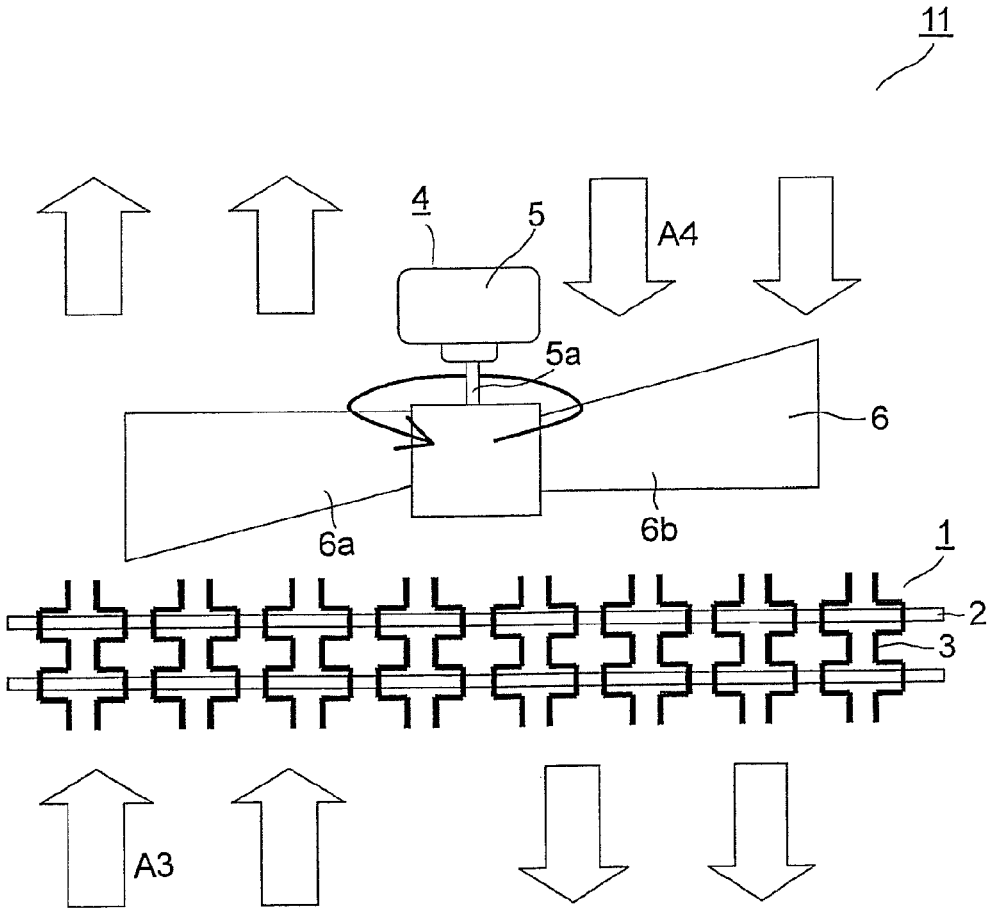
FIG. 13 A schematic structural view showing a heat exchanging system according to a third embodiment of the present invention.

FIG. 13 is a schematic structural view showing a heat exchanging system according to a third embodiment. For the sake of convenience of explanation, like reference symbols denote parts corresponding to those of the previously described first embodiment shown in FIG. 1. In a heat exchanging system 11 according to this embodiment, a vane 6 of a fan 4 is configured differently from the first embodiment. Parts other than this are configured similarly to those of the first embodiment.

The fan 4 is formed of an axial flow fan, and the vane 6 is composed of vane blades 6*a* and 6*b* having mutually opposite angles of attack, which are arranged alternately in a rotation direction. The fan 4 is driven at a constant rpm, and in the figure, with respect to a left side portion of a heat exchanger 1 opposed to the vane blade 6*a*, a second fluid is introduced thereto in a direction indicated by an arrow A3. In the figure, with respect to a right side portion of the heat exchanger 1 opposed to the vane blade 6*b*, the second fluid is introduced thereto in a direction indicated by an arrow A4. That is, in a position opposed to the vane blade 6*a*, a main flow direction of the second fluid passing between fins 3 of the heat exchanger 1 is reverse to that in a position opposed to the vane blade 6*b* as indicated by the arrows A3 and A4, respectively.

Figure 14:
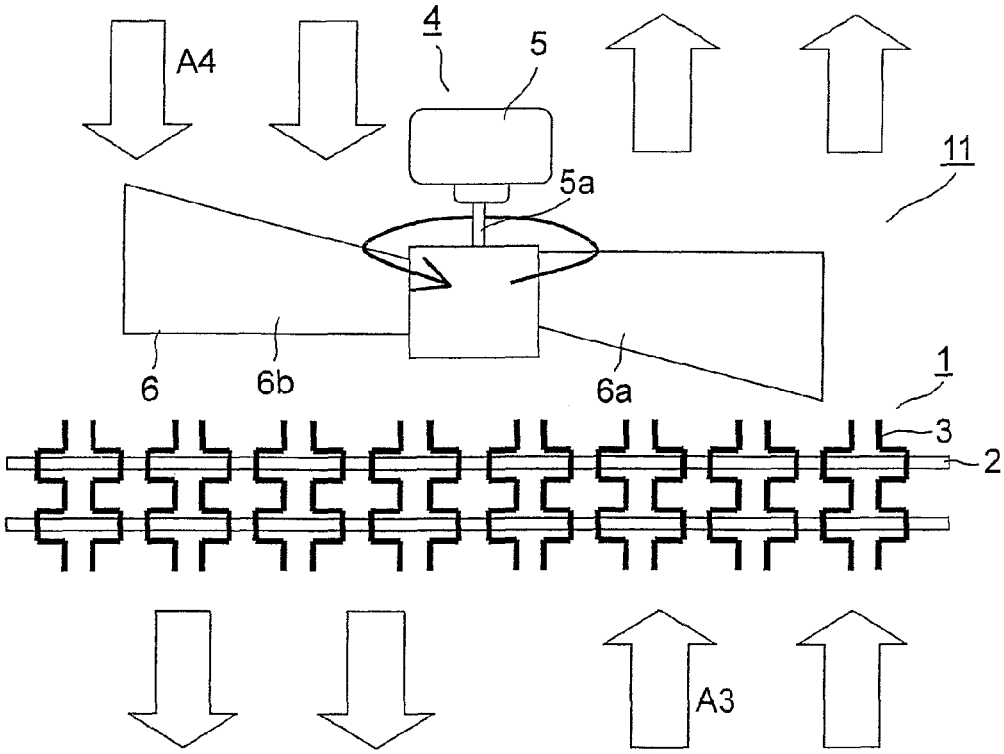
FIG. 14 A schematic structural view showing the heat exchanging system according to the third embodiment of the present invention.

When the state shown in FIG. 14 is brought about by rotation of the vane 6, in the figure, the left side portion of the heat exchanger 1 is opposed to the vane blade 6*b*, and the second fluid is introduced thereto in the direction indicated by the arrow A4. In the figure, the right side portion of the heat exchanger 1 is opposed to the vane blade 6*a*, and the second fluid is introduced thereto in the direction indicated by the arrow A3. Furthermore, a flow rate in each of the portions of the heat exchanger 1 decreases when the vane blades 6*a* and 6*b* rotate away from the portions and increases when the vane blades 6*a* and 6*b* rotate to approach the portions. That is, through driving of the fan 4, the flow rate of the second fluid passing through the heat exchanger 1 is made variable and the passage direction thereof is inverted.

Thus, a similar effect to that of the first embodiment can be obtained. Particularly in this embodiment, there is no need to invert forward/reverse rotation of a fan motor, thereby achieving a mechanism simpler than that of the first embodiment. Furthermore, forward/reverse rotation of a fan motor is inverted at a relatively long cycle due to the influence of inertia, and the vane blade 6*a* or 6*b* passes over an arbitrary portion of the heat exchanger at a cycle shorter than that cycle. Therefore, a passage direction can be inverted at an increased frequency within a fixed time period. Consequently, stagnation and renewal of a fluid in the concave part can be performed at a higher frequency than in the first embodiment. As the heat exchanger 1, a heat exchanger of a configuration similar to that of the second embodiment also may be used.

Fourth Embodiment

Figure 15:
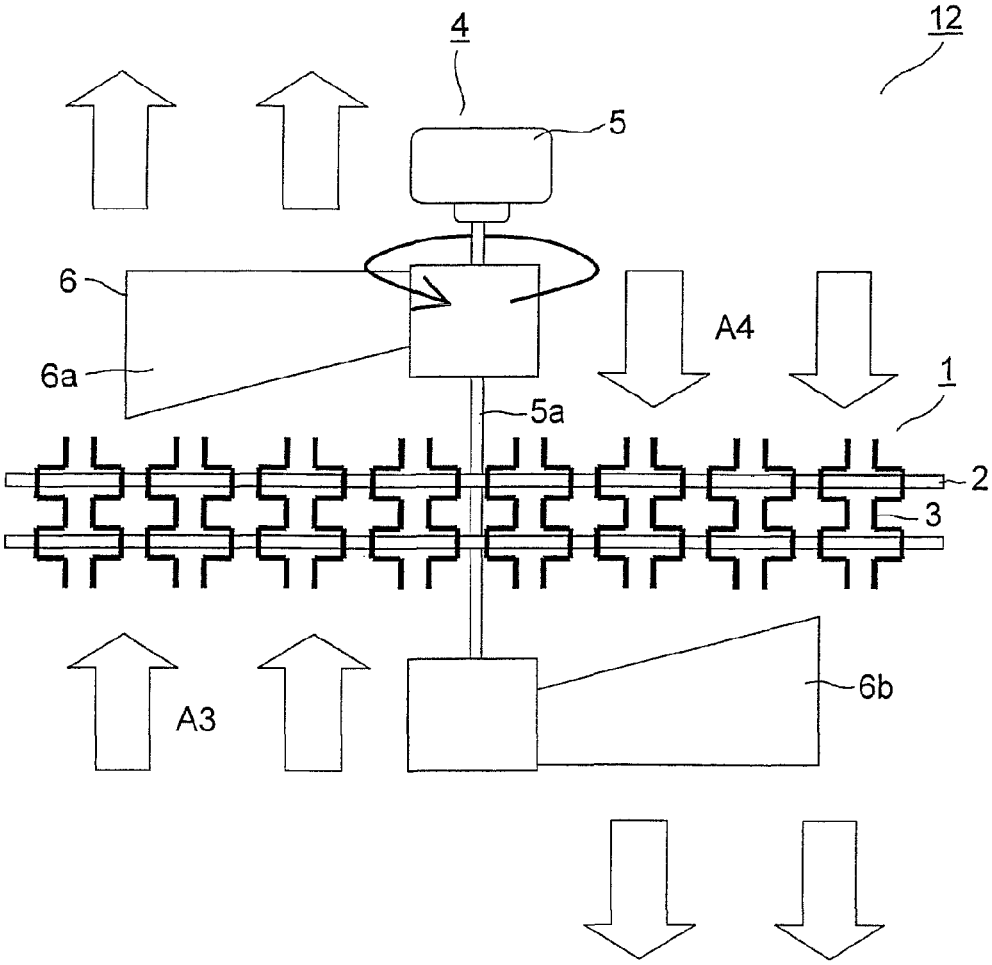
FIG. 15 A schematic structural view showing a heat exchanging system according to a fourth embodiment of the present invention.

FIG. 15 is a schematic structural view showing a heat exchanging system according to a fourth embodiment. For the sake of convenience of explanation, like reference symbols denote parts corresponding to those of the previously described third embodiment shown in FIGS. 13 and 14. In a heat exchanging system 12 according to this embodiment, a vane 6 is attached to a fan 4 differently from the third embodiment. Parts other than this are configured similarly to those of the third embodiment.

The vane 6 of the fan 4 includes vane blades 6*a* and 6*b* having mutually opposite angles of attack. A motor shaft 5*a* is provided so as to penetrate between fins 3 of a heat exchanger 1, and the vane blades 6*a* and 6*b* are attached to both ends of the motor shaft 5*a*, respectively, so as to sandwich the heat exchanger 1 therebetween.

The fan 4 is driven at a constant rpm, and in the figure, with respect to a left side portion of the heat exchanger 1 opposed to the vane blade 6*a*, a second fluid is introduced thereto in a direction indicated by an arrow A3. In the figure, with respect to a right side portion of the heat exchanger 1 opposed to the vane blade 6*b*, the second fluid is introduced thereto in a direction indicated by an arrow A4. That is, in a position opposed to the vane blade 6*a*, a main flow direction of the second fluid passing between the fins 3 of the heat exchanger 1 is reverse to that in a position opposed to the vane blade 6*b* as indicated by the arrows A3 and A4, respectively.

Figure 16:
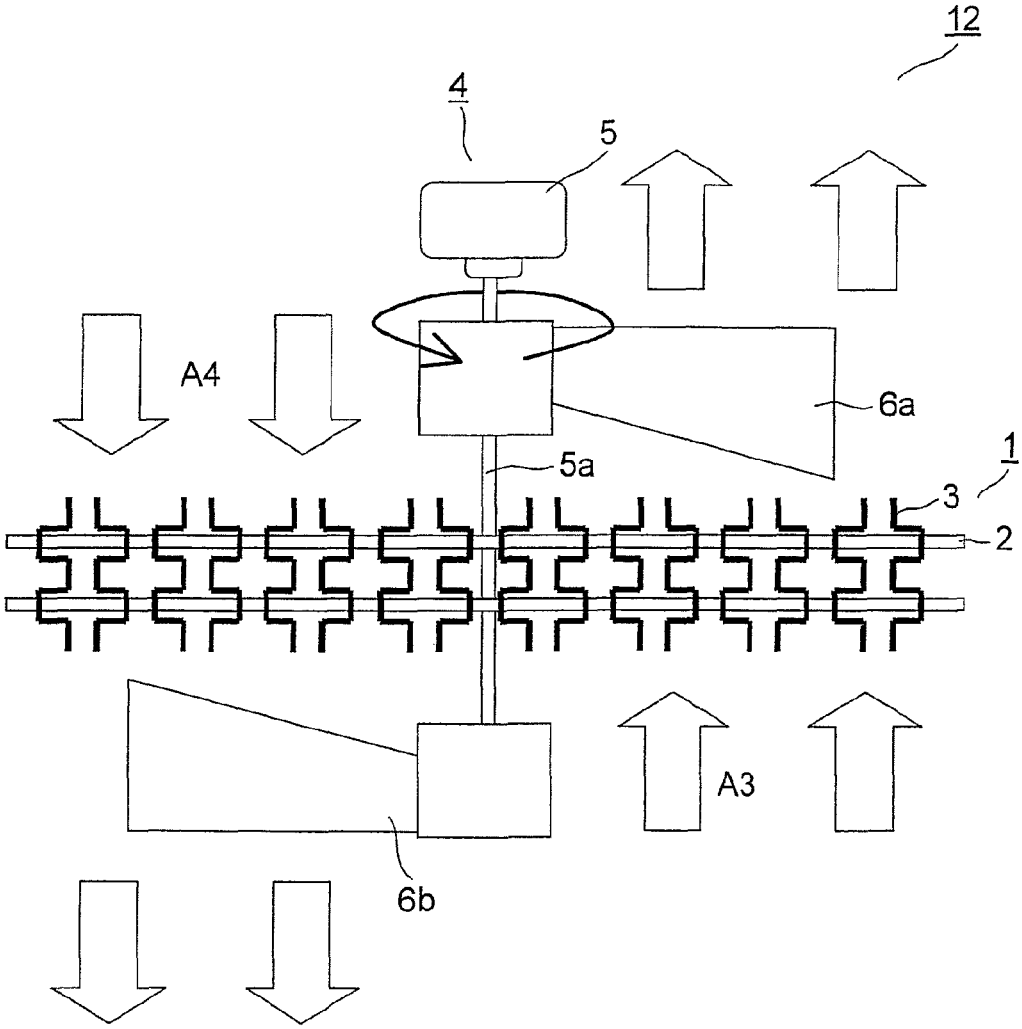
FIG. 16 A schematic structural view showing the heat exchanging system according to the fourth embodiment of the present invention.

When the state shown in FIG. 16 is brought about by rotation of the vane 6, in the figure, the left side portion of the heat exchanger 1 is opposed to the vane blade 6*b*, and the second fluid is introduced thereto in the direction indicated by the arrow A4. In the figure, the right side portion of the heat exchanger 1 is opposed to the vane blade 6*a*, and the second fluid is introduced thereto in the direction indicated by the arrow A3. Furthermore, a flow rate in each of the portions of the heat exchanger 1 decreases when the vane blades 6*a* and 6*b* rotate away from the portions and increases when the vane blades 6*a* and 6*b* rotate to approach the portions. That is, through driving of the fan 4, the flow rate of the second fluid passing through the heat exchanger 1 is made variable and the passage direction thereof is inverted.

Thus, a similar effect to that of the third embodiment can be obtained. As the heat exchanger 1, a heat exchanger of a configuration similar to that of the second embodiment also may be used.

Fifth Embodiment

Figure 17:
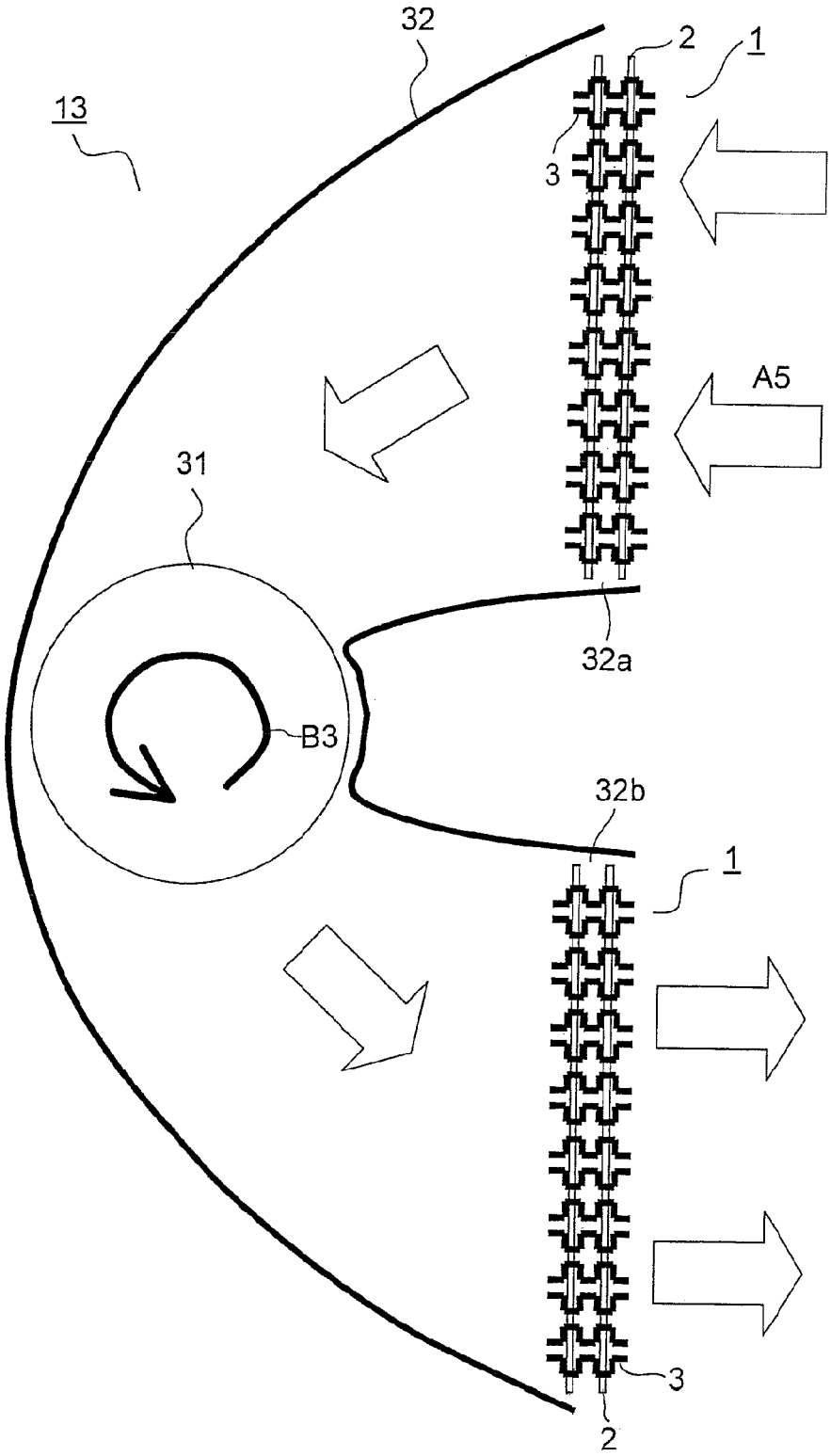
FIG. 17 A schematic structural view showing a heat exchanging system according to a fifth embodiment of the present invention.

FIG. 17 is a schematic structural view showing a heat exchanging system according to a fifth embodiment. For the sake of convenience of explanation, like reference symbols denote parts corresponding to those of the previously described first embodiment shown in FIGS. 1 and 2. In a heat exchanging system 13 according to this embodiment, a fan 31 is formed of a once-through fan such as a cross flow fan, and a heat exchanger 1 of a configuration similar to that of the first embodiment is disposed at each of openings 32*a* and 32*b* that are provided on both ends of a casing 32, respectively.

Figure 18:
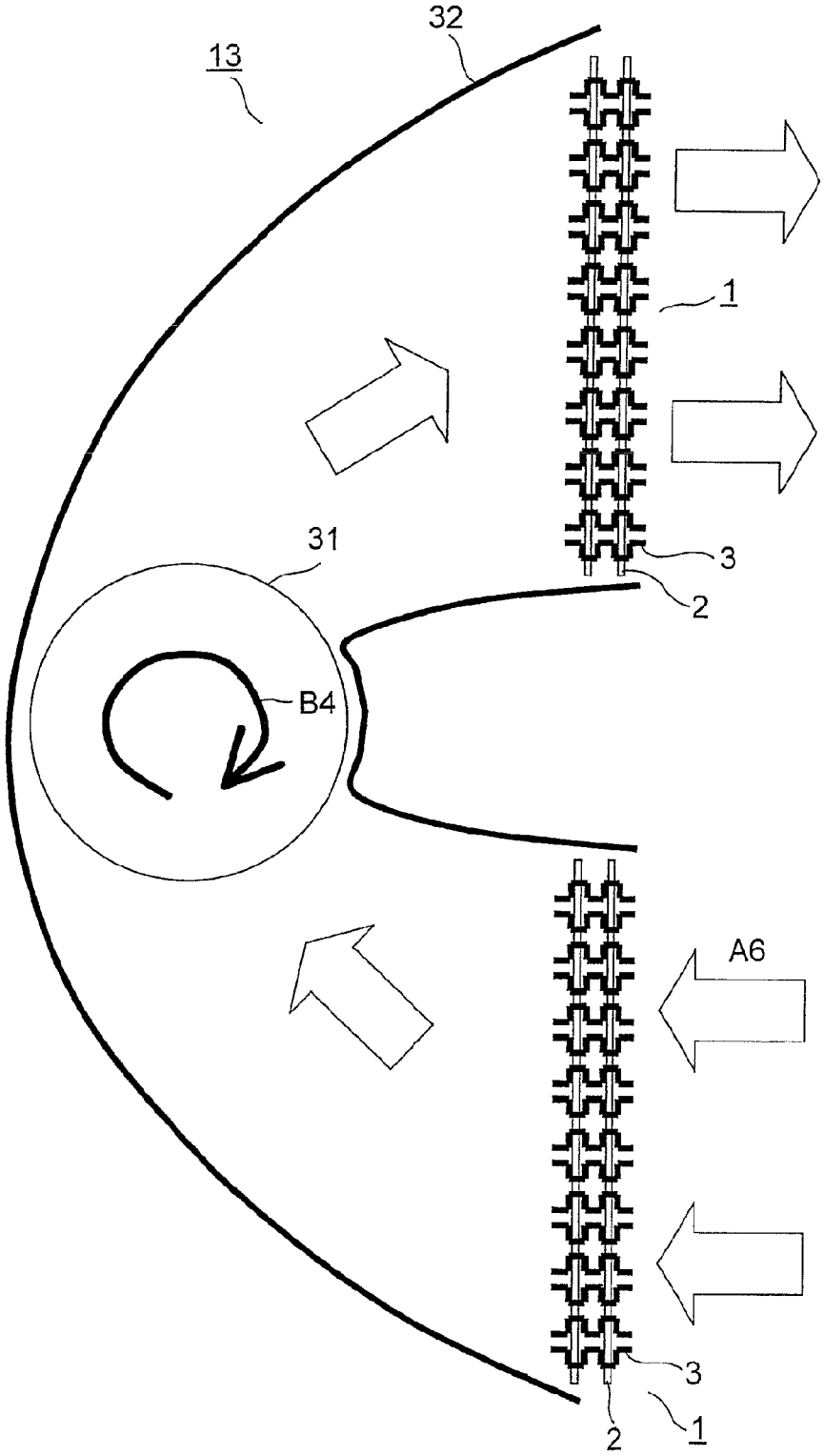
FIG. 18 A schematic structural view showing the heat exchanging system according to the fifth embodiment of the present invention.

The fan 31 is rotated sinusoidally, i.e. the rpm thereof is increased and decreased and the rotation direction thereof is inverted. In this configuration, when the fan 31 rotates in a direction indicated by an arrow B3, a second fluid flows from the opening 32*a* toward the opening 32*b* as indicated by an arrow A5. When the fan 31 rotates in a direction indicated by an arrow B4 as shown in FIG. 18, the second fluid flows from the opening 32*b* toward the opening 32*a* as indicated by an arrow A6.

Thus, a similar effect to that of the first embodiment can be obtained. Particularly by using a once-through fan as in this embodiment, a volume and a velocity of air in an axial direction of the fan 31 (a direction perpendicular to the plane of FIG. 17) can be made more uniform than in the cases of using an axial flow fan and a centrifugal fan, respectively. This configuration therefore is suitable for achieving uniform heat exchange performance in a fan axial direction of the heat exchanger 1.

As the heat exchanger 1, a heat exchanger of a configuration similar to that of the second embodiment also may be used. Furthermore, it also is possible that the rotation velocity of the fan 31 is made variable with the rotation direction thereof fixed. In this case, the second fluid passing through the heat exchanger 1 is made variable in flow rate with the flow direction thereof fixed.

Sixth Embodiment

Figure 19:
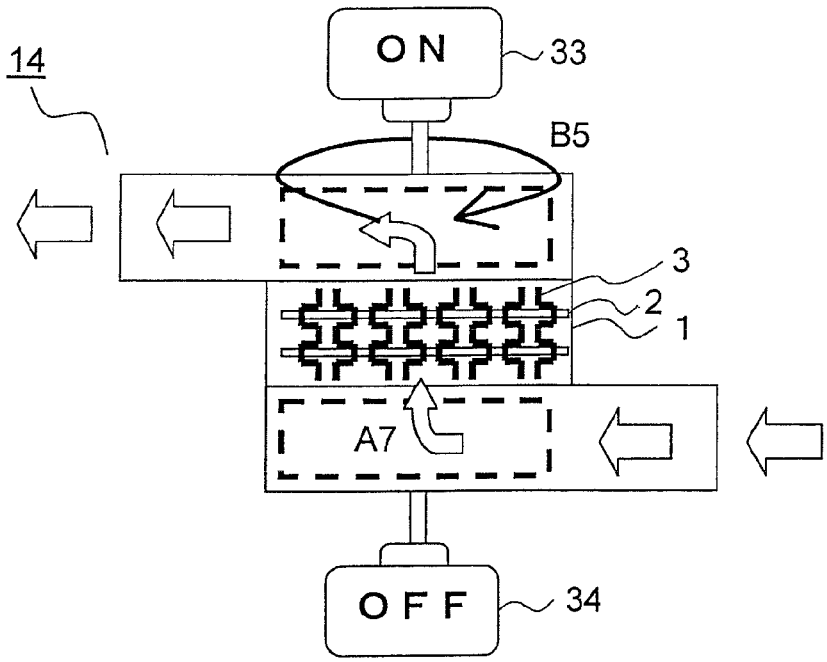
FIG. 19 A schematic structural view showing a heat exchanging system according to a sixth embodiment of the present invention.

FIG. 19 is a schematic structural view showing a heat exchanging system according to a sixth embodiment. For the sake of convenience of explanation, like reference symbols denote parts corresponding to those of the previously described first embodiment shown in FIGS. 1 to 2. In a heat exchanging system 14 according to this embodiment, fans 33 and 34 formed of a centrifugal fan such as a sirocco fan are disposed on both sides of a heat exchanger 1 of a configuration similar to that of the first embodiment, respectively.

Figure 20:
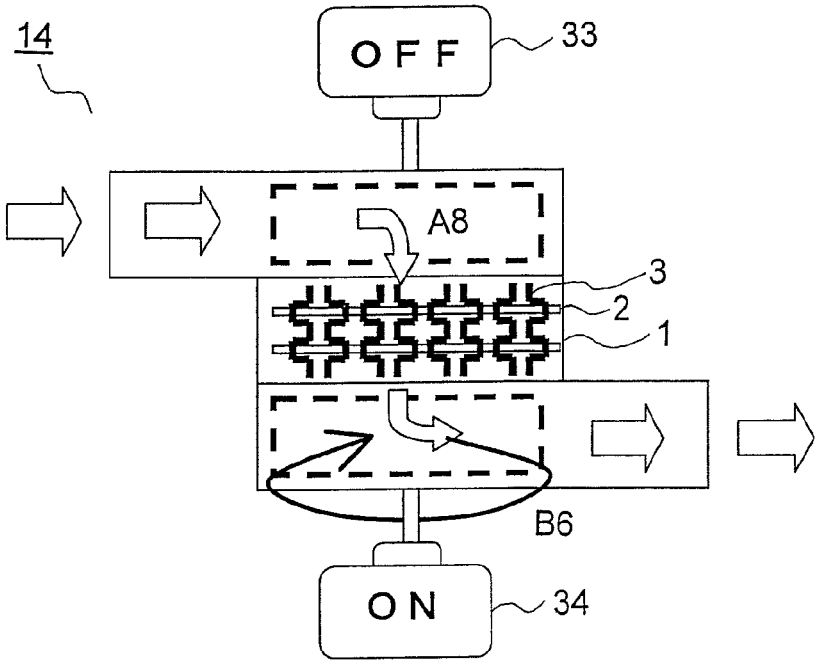
FIG. 20 A schematic structural view showing the heat exchanging system according to the sixth embodiment of the present invention.

The fans 33 and 34 are driven alternately, and the rpm thereof increases at a start-up of a driving operation and decreases when the driving operation is halted. When the fan 33 is driven with the fan 34 brought to a non-operation state, a second fluid flows from the fan 34 toward the fan 33 in a direction indicated by an arrow A7. When the fan 34 is driven with the fan 33 brought to a non-operation state as shown in FIG. 20, the second fluid flows from the fan 33 toward the fan 34 in a direction indicated by an arrow A8. In this manner, the flow rate of the second fluid passing through the heat exchanger 1 is increased and decreased and a main flow direction thereof is inverted.

Thus, a similar effect to that of the first embodiment can be obtained. The fans 33 and 34 also may be formed of a once-through fan or an axial flow fan, and, more preferably, they are formed of a centrifugal fan such as a sirocco fan. This is because using a centrifugal fan as each of the fans 33 and 34 allows a desired form of fluid delivery even when there is a large pressure loss as an intrinsic problem. Therefore, even in the case where the heat exchanger 1 of the heat exchanging system 14 has an increased thickness in the main flow direction, effective heat exchange performance can be obtained. As the heat exchanger 1, a heat exchanger of a configuration similar to that of the second embodiment also may be used.

Seventh Embodiment

Figure 21:
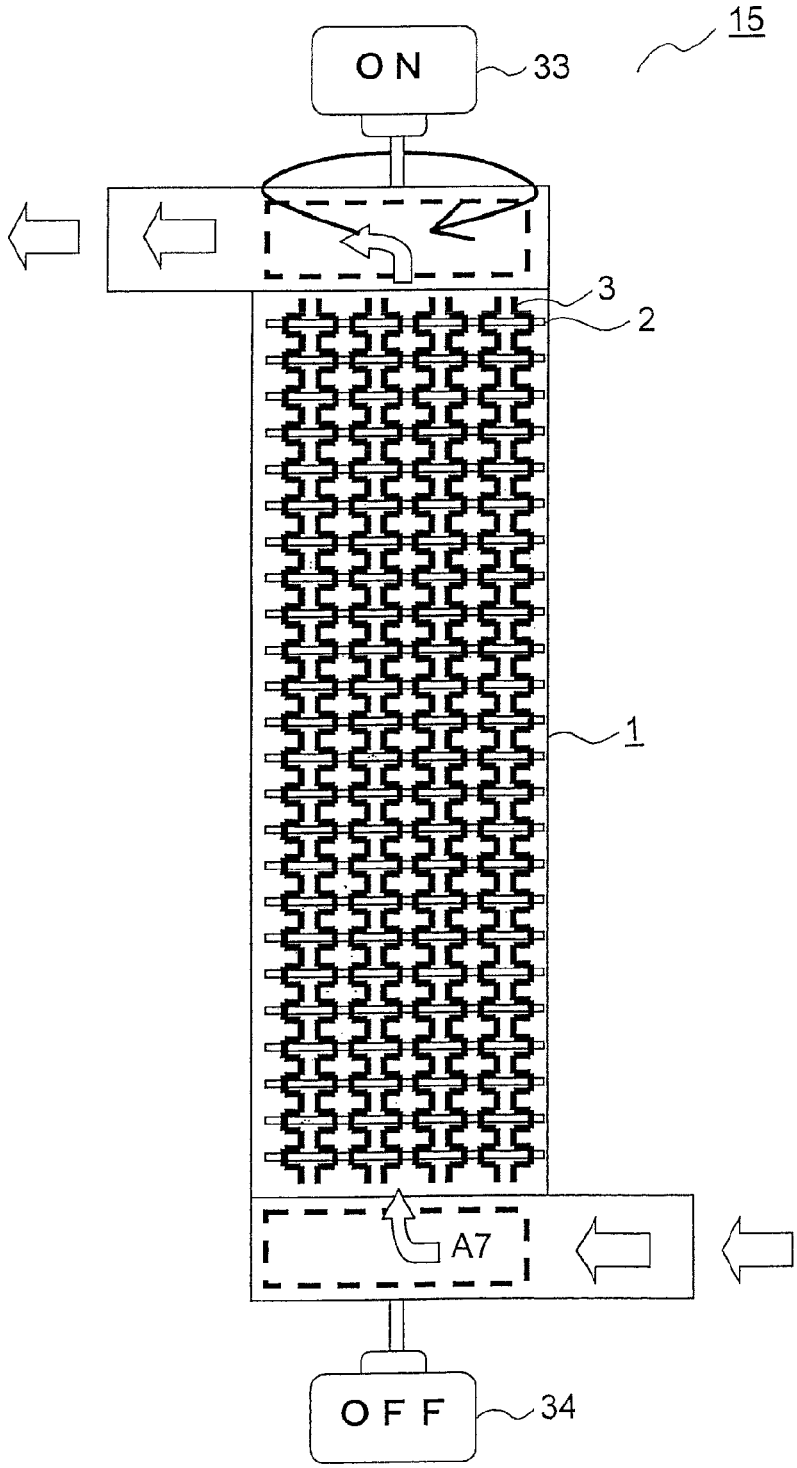
FIG. 21 A schematic structural view showing a heat exchanging system according to a seventh embodiment of the present invention.

FIG. 21 is a schematic structural view showing a heat exchanging system according to a seventh embodiment. For the sake of convenience of explanation, like reference symbols denote parts corresponding to those of the previously described sixth embodiment shown in FIGS. 19 and 20. In a heat exchanging system 15 according to this embodiment, with respect to the sixth embodiment, tubes 2 of a heat exchanger 1 are arranged in an increased number of rows, and the heat exchanger 1 therefore has an increased thickness in a main flow direction. Parts other than this are configured similarly to those of the sixth embodiment.

According to this embodiment, a fin 3 has an increased length in the main flow direction, thereby allowing a heat exchange area to be increased. Furthermore, fans 33 and 34 are formed of a centrifugal fan, and thus a desired form of fluid delivery can be performed even when there is a large pressure loss. This allows high heat exchange performance to be obtained.

Eighth Embodiment

Figure 22:
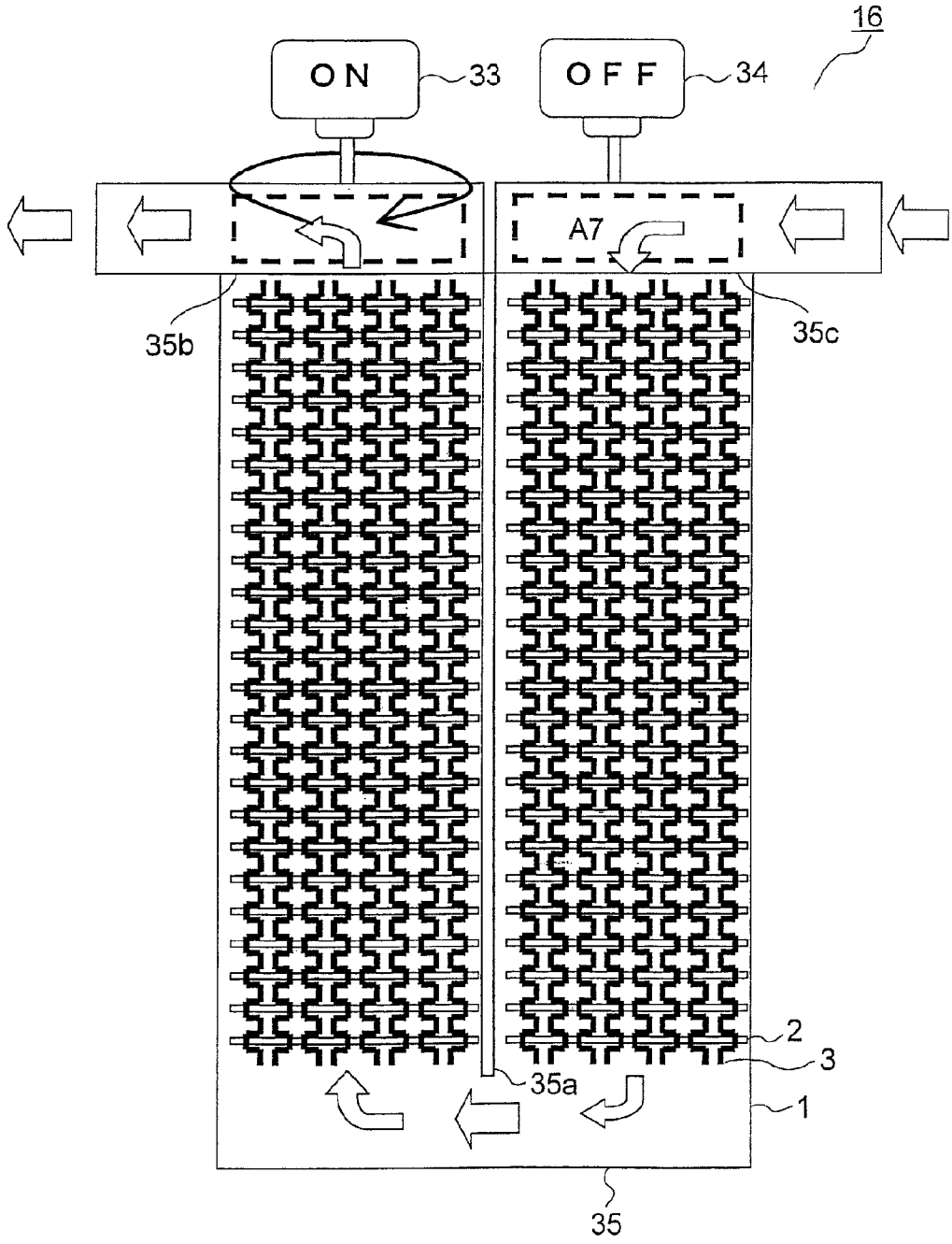
FIG. 22 A schematic structural view showing a heat exchanging system according to an eighth embodiment of the present invention.

FIG. 22 is a schematic structural view showing a heat exchanging system according to an eighth embodiment. For the sake of convenience of explanation, like reference symbols denote parts corresponding to those of the previously described sixth embodiment shown in FIGS. 19 and 20. In a heat exchanging system 16 according to this embodiment, with respect to the sixth embodiment, tubes 2 of a heat exchanger 1 are arranged in an increased number of rows, and two similarly configured heat exchangers are provided side by side as the heat exchangers 1. Parts other than these are configured similarly to those of the sixth embodiment.

The two heat exchangers 1 are disposed in a casing 35 with a partition 35*a* interposed therebetween. The partition 35*a* is open at a lower portion in the figure and thus allows the heat exchangers 1 to communicate with each other. Accordingly, the two heat exchangers 1 have an increased length in a main flow direction. At an upper portion of the casing 35, openings 35*b* and 35*c* are provided so as to be isolated from each other by the partition 35*a*, and fans 33 and 34 are disposed at the openings 35*b* and 35*c*, respectively.

According to this embodiment, a fin 3 has an increased length in the main flow direction and the two heat exchangers 1 are provided side by side, thereby allowing a heat exchange area to be increased. Furthermore, the fans 33 and 34 are formed of a centrifugal fan, and thus a desired form of fluid delivery can be performed even when there is a large pressure loss. This allows high heat exchange performance to be obtained.

Furthermore, the fans 33 and 34 are disposed collectively on one side in the heat exchanging system 16, and thus this embodiment is effective in the case where an inlet for drawing in a second fluid from the exterior and an outlet for discharging it should be provided on one side in the heat exchanging system.

Ninth Embodiment

Figure 23:
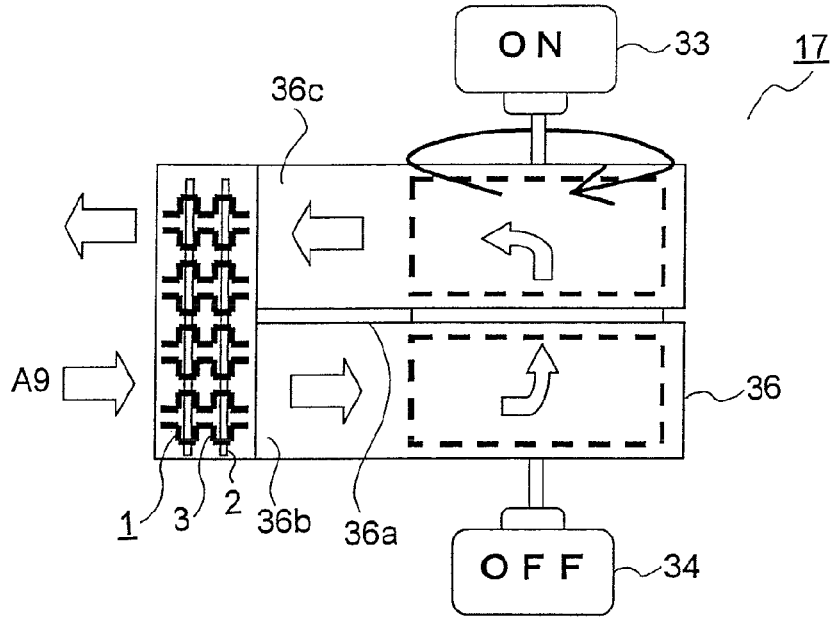
FIG. 23 A schematic structural view showing a heat exchanging system according to a ninth embodiment of the present invention.

FIG. 23 is a schematic structural view showing a heat exchanging system according to a ninth embodiment. For the sake of convenience of explanation, like reference symbols denote parts corresponding to those of the previously described sixth embodiment shown in FIGS. 19 and 20. In a heat exchanging system 17 according to this embodiment, fans 33 and 34 formed of a centrifugal fan such as a sirocco fan are disposed so as to be opposed to each other. Furthermore, a heat exchanger 1 of a configuration similar to that of the sixth embodiment is disposed in a circumferential direction of the fans 33 and 34.

A casing 36 of the fans 33 and 34 is open at one end thereof, where openings 36*b* and 36*c* are formed so as to be isolated from each other by a partition 36*a*. The heat exchanger 1 is disposed so as to lie across the openings 36*b* and 36*c*. The fans 33 and 34 are disposed at the other end of the casing 36 so as to be opposed to each other in an axial direction, and the openings 36*b* and 36*c* are allowed to communicate with each other through the partition 36*a* by means of the fans 33 and 34. The fans 33 and 34 draw in a second fluid in the axial direction and deliver it in the circumferential direction.

Figure 24:
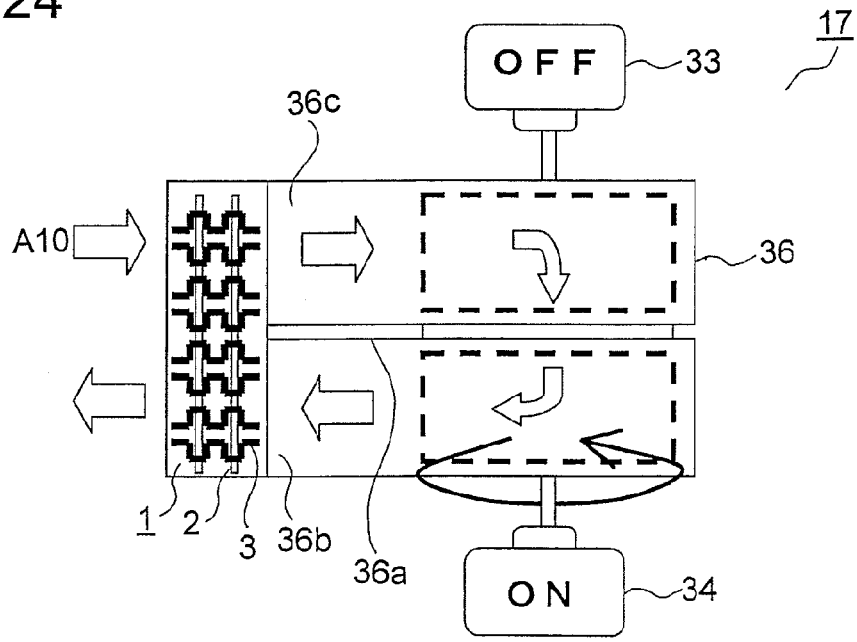
FIG. 24 A schematic structural view showing the heat exchanging system according to the ninth embodiment of the present invention.

The fans 33 and 34 are driven alternately, and the rpm thereof increases at a start-up of a driving operation and decreases when the driving operation is halted. When the fan 33 is driven with the fan 34 brought to a non-operation state, the second fluid flows from the fan 34 toward the fan 33 in a direction indicated by an arrow A9. When the fan 34 is driven with the fan 33 brought to a non-operation state as shown in FIG. 24, the second fluid flows from the fan 33 toward the fan 34 in a direction indicated by an arrow A10. In this manner, the flow rate of the second fluid passing through the heat exchanger 1 is increased and decreased and a main flow direction thereof is inverted.

Thus, a similar effect to that of the first embodiment can be obtained. Furthermore, the fans 33 and 34 are formed of a centrifugal fan, and thus a desired form of fluid delivery can be performed even when there is a large pressure loss as an intrinsic problem. Therefore, even in the case where the heat exchanger 1 of the heat exchanging system 17 has an increased thickness in the main flow direction, effective heat exchange performance can be obtained. As the heat exchanger 1, a heat exchanger of a configuration similar to that of the second embodiment also may be used.

Tenth Embodiment

Figure 25:
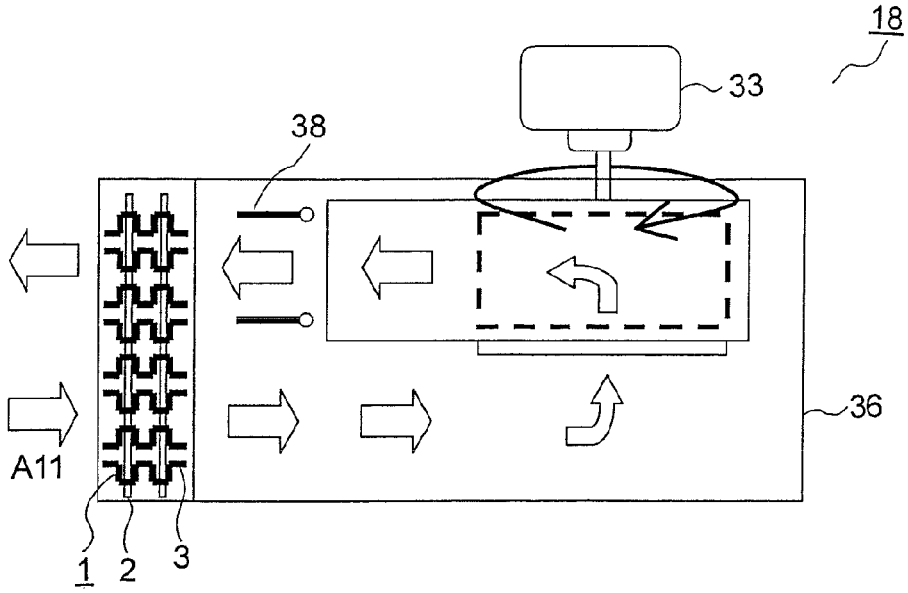
FIG. 25 A schematic structural view showing a heat exchanging system according to a tenth embodiment of the present invention.

FIG. 25 is a schematic structural view showing a heat exchanging system according to a tenth embodiment. For the sake of convenience of explanation, like reference symbols denote parts corresponding to those of the previously described ninth embodiment shown in FIGS. 23 and 24. In a heat exchanging system 18 according to this embodiment, with respect to the ninth embodiment, the fan 34 as one of the fans (see FIG. 23) and the partition 36*a* (see FIG. 23) are omitted, and a guide unit 38 is provided. Parts other than these are configured similarly to those of the ninth embodiment.

The guide unit 38 is formed of a circularly movable louver disposed on a downstream side of a fan 33 and makes the flow direction of a second fluid delivered from the fan 33 variable at a regular cycle. Furthermore, the guide unit 38 is provided so as to be opposed to a portion of a heat exchanger 1 extending in a direction perpendicular to the plane of the figure.

When the fan 33 is driven, as indicated by an arrow A11, the second fluid flows into a casing 36 by passing through a portion of the heat exchanger 1 other than the portion opposed to the guide unit 38. The fan 33 draws in the second fluid in an axial direction and delivers it in a circumferential direction, and the second fluid is guided by the guide unit 38 to pass through the portion of the heat exchanger 1 opposed to the guide unit 38.

Figure 26:
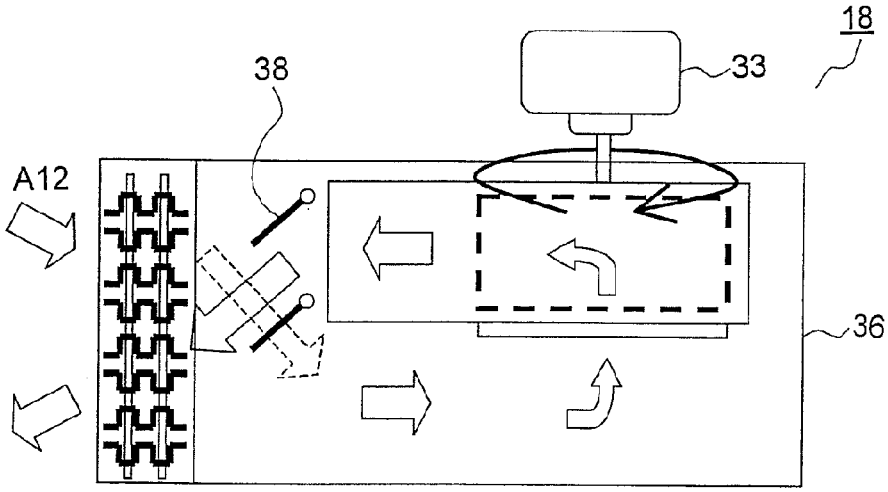
FIG. 26 A schematic structural view showing the heat exchanging system according to the tenth embodiment of the present invention.

When the orientation of the guide unit 38 is changed as shown in FIG. 26, the second fluid delivered from the fan 33 is guided in the extending direction of the guide unit 38. The second fluid then flows out from the casing 36 through a portion of the heat exchanger 1 on an imaginary line extending from the guide unit 38. At this time, the second fluid is introduced from the guide unit 38 to the heat exchanger 1 obliquely to a fin 3 and then flows along the fin 3 in a main flow direction. Furthermore, the second fluid flows into the casing 36 through a portion of the heat exchanger 1 other than a portion through which the second fluid flows out.

Therefore, through a circular movement of the guide unit 38, the second fluid is made variable in flow rate and in flow direction in each of the portions of the heat exchanger 1. Thus, a similar effect to that of the ninth embodiment can be obtained. Furthermore, the flow direction of the second fluid being introduced to the fin 3 of the heat exchanger 1 is made variable at a regular cycle, and thus the second fluid easily can be made variable in flow rate and in flow direction in each of the portions of the heat exchanger 1. Particularly, this embodiment is advantageous in that a flow direction in each portion can be inverted at a time interval more frequent than a cycle at which forward/reverse rotation of a fan motor is inverted or than a cycle at which switching between on/off states is performed. As the heat exchanger 1, a heat exchanger of a configuration similar to that of the second embodiment also may be used.

Eleventh Embodiment

Figure 27:
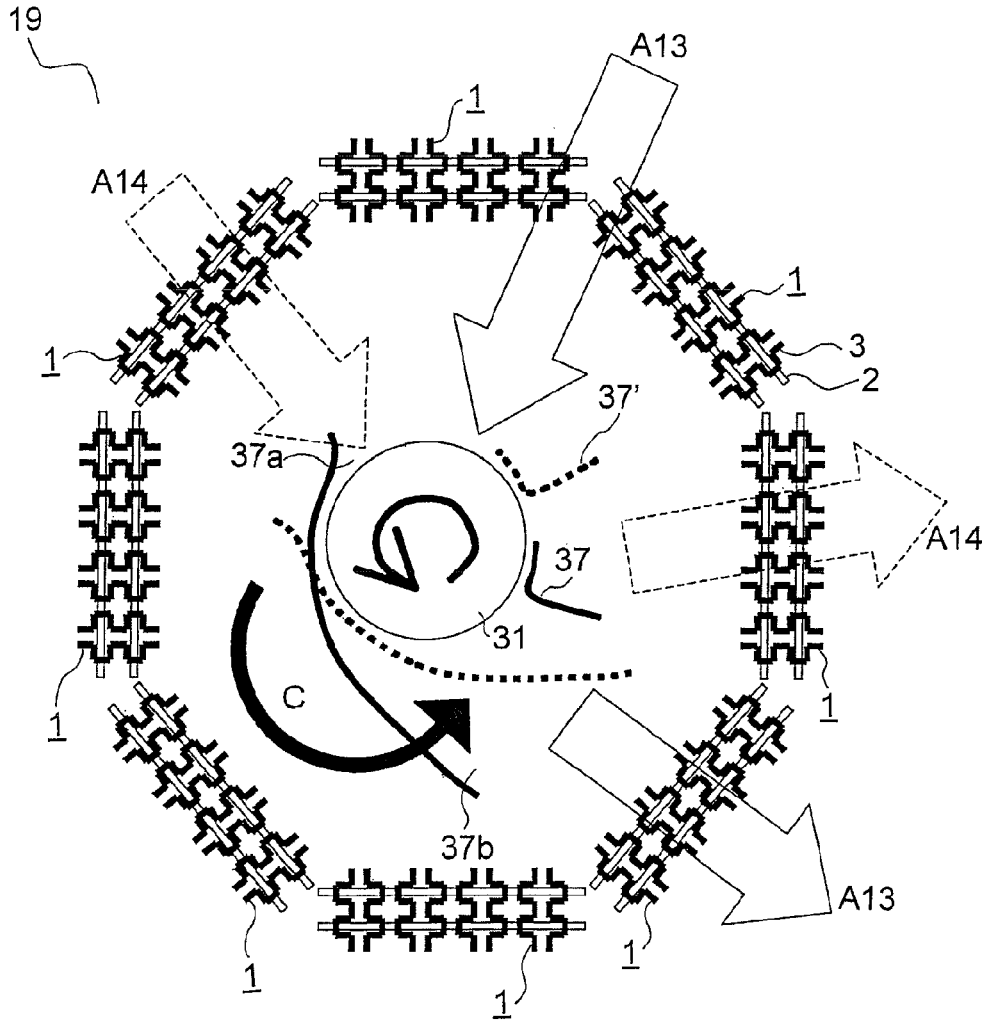
FIG. 27 A schematic structural view showing a heat exchanging system according to an eleventh embodiment of the present invention.
Figure 28:
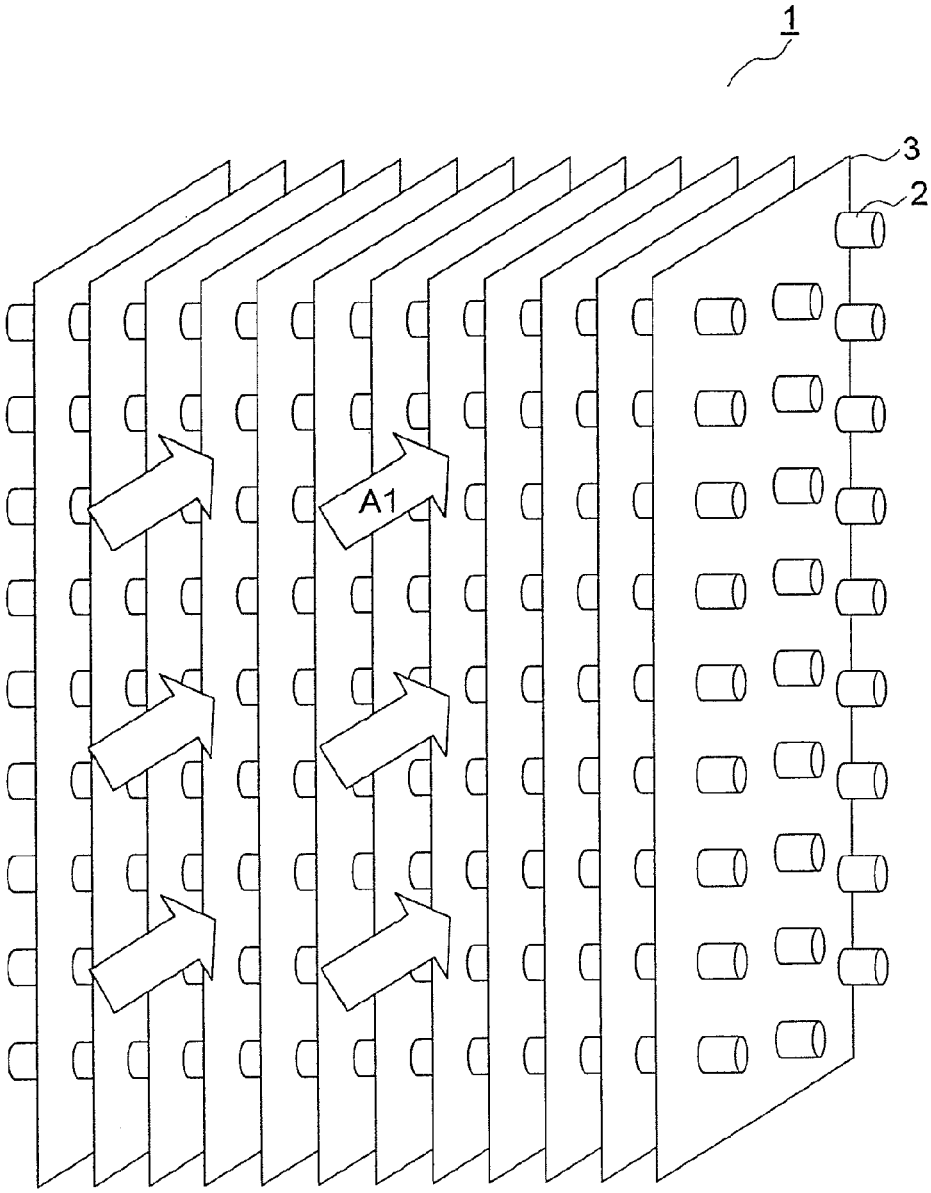
FIG. 28 A perspective view showing a heat exchanger of a heat exchanging system according to the conventional technique.

FIG. 27 is a schematic structural view showing a heat exchanging system according to an eleventh embodiment. For the sake of convenience of explanation, like reference symbols denote parts corresponding to those of the previously described first embodiment shown in FIGS. 1 and 2. In a heat exchanging system 19 according to this embodiment, a fan 31 is formed of a once-through fan such as a cross flow fan, and a plurality of heat exchangers 1 of a configuration similar to that of the first embodiment are arranged so as to surround the periphery of a casing 37 of the fan 31.

The casing 37 of the fan 31 has a flow-in port 37*a* and a flow-out port 37*b* that are provided on both ends thereof, respectively, and is rotatable as indicated by an arrow C. In this configuration, when the fan 31 is driven, a second fluid passes through whichever of the heat exchangers 1 faces the flow-in port 37*a* as indicated by an arrow A13 and flows into the casing 37 through the flow-in port 37*a*. The second fluid then flows out from the casing 37 through the flow-out port 37*b* and passes through whichever of the heat exchangers 1 faces the flow-out port 37*b*.

When the casing 37 is brought to a position indicated by a broken line 37' through a circular movement thereof, the second fluid passes through whichever of the heat exchanges 1 faces the flow-in port 37*a* in a corresponding position as shown by an arrow A14 and flows into the casing 37 though the flow-in port 37*a*. The second fluid then flows out from the casing 37 through the flow-out port 37*b* and passes through whichever of the heat exchanger 1 faces the flow-out port 37*b*.

Since the casing 37 is rotatable, in each of the heat exchangers 1, the flow rate of the second fluid is increased and decreased at a regular cycle and the flow direction thereof is inverted at a regular cycle. Thus, a similar effect to that of the first embodiment can be obtained. Furthermore, the flow direction of the second fluid being introduced to a fin 3 of each of the heat exchangers 1 is made variable at a regular cycle, and thus a flow rate easily can be made variable. As each of the heat exchangers 1, a heat exchanger of a configuration similar to that of the second embodiment also may be used. Furthermore, a centrifugal fan also may be used in place of a once-through fan. Furthermore, it also is possible to allow the fan 31 to swing. In this case, when the fan 31 is set to swing at an angle of 180° or smaller, the second fluid passing through the heat exchangers 1 is made variable in flow rate with the flow direction thereof fixed.

In the foregoing discussion, the heat exchanging system according to the present invention has been described by way of the first to eleventh embodiments. However, the present invention is not limited to the above-described embodiments and can be modified variously as appropriate without departing from the spirit of the present invention.

INDUSTRIAL APPLICABILITY

The present invention can be applied to a heat-dissipating device or a cooling device for motors of, for example, air conditioners, air heaters, boilers, and automobiles and for high-heat-generating electronic components.

LIST OF REFERENCE SYMBOLS

1 Heat exchanger
2 Tube
3 Fin
4, 31, 33, 34 Fan
5 Motor
6, 6*a*, 6*b* Vane, Vane blade
7 Concave part
7*a*, 7*b*, 7*c* Vortex
8 Convex part
8*a* Flat surface portion
10 to 19 Heat exchanging system
32, 35, 36, 37 Casing

The invention claimed is:

1. A heat exchanging system, comprising:

a heat exchanger including a tube for a first fluid to flow therethrough and a plurality of fins that are formed of thin plates, that are attached to the tube, and that are arranged side by side in an extending direction of the tube; and a fan for introducing a second fluid between the fins, wherein the fins meander so as to have continuous concave and convex parts formed at a regular pitch, the concave and convex parts are arranged so as to extend in a direction intersecting a passage direction of the second fluid passing between the fins, and a flow rate of the second fluid passing between the fins is made variable at a regular cycle so as to bring about, at a regular cycle, a first state where a vortex stays in the concave part and becomes stagnant and a second state where a portion of the vortex extends out of the concave part due to a decrease in angular velocity of the vortex and heat exchange is performed between the portion of the vortex and a flow of the second fluid flowing between the fins.

2. The heat exchanging system according to claim 1, wherein a flow direction of the second fluid passing between the fins is inverted at a regular cycle so as to bring about, at a regular cycle, subsequently to the first and second states, a third state where the second fluid in the inverted flow direction flows into the concave part along the concave part and a fourth state where a vortex that rotates reversely to the vortex in the first state is generated in the concave part.

3. The heat exchanging system according to claim 2, wherein a flow direction of the second fluid being introduced to the fins is made variable at a regular cycle.

4. The heat exchanging system according to claim 1, wherein the concave and convex parts are arranged so as to extend in a direction orthogonal to the passage direction of the second fluid passing between the fins.

5. The heat exchanging system according to claim 1, wherein open sides of the concave parts of adjacent ones of the fins face each other.

6. The heat exchanging system according to claim 1, wherein the concave part of each of the fins faces the convex part of an adjacent one of the fins.

7. The heat exchanging system according to claim 1, wherein the convex part has a flat surface portion parallel to the passage direction of the second fluid passing between the fins, and the flat surface portion is continuous with a side wall of the concave part and forms a right angle or an acute angle with the side wall of the concave part.

8. The heat exchanging system according to claim 7, wherein the concave part has a rectangular shape in cross-section.

9. The heat exchanging system according to claim 1, wherein when the second fluid passes between the fins at a maximum flow velocity, a Reynolds number obtained with respect to a length of the concave part or the convex part in a passage direction as a representative length has a value larger than a critical Reynolds number.

10. The heat exchanging system according to claim 9, wherein when the second fluid passes between the fins at a minimum flow velocity, the Reynolds number obtained has a value smaller than the critical Reynolds number.

11. The heat exchanging system according to claim 2, wherein the fan is formed of an axial flow fan or a once-through fan, and a rotation direction of the fan is inverted at a regular cycle.

12. The heat exchanging system according to claim 2, wherein the fan is formed of an axial flow fan having a plurality of vane blades, and at least some of the vane blades are provided so as to have opposite angles of attack.

13. The heat exchanging system according to claim 2, wherein the fan is disposed on each of an upstream side and a downstream side of the heat exchanger, and the fan disposed on the upstream side and the fan disposed on the downstream side are driven alternately.

14. The heat exchanging system according to claim 13, wherein the fan is formed of a centrifugal fan.

15. The heat exchanging system according to claim 2, wherein a guide unit that guides the second fluid is provided on an upstream side or a downstream side of the fan, and by the guide unit, a flow direction of the second fluid is made variable at a regular cycle.

16. The heat exchanging system according to claim 2, wherein the fan is formed of a once-through fan or a centrifugal fan that is enclosed in a casing, on both ends of which a flow-in port and a flow-out port for the second fluid are provided, respectively, the heat exchanger is disposed so as to surround a periphery of the fan, and the casing is configured to be rotatable.

* * * * *